US011459766B2

(12) United States Patent
Seeboth et al.

(10) Patent No.: US 11,459,766 B2
(45) Date of Patent: Oct. 4, 2022

(54) LEVELING PARTITION MOUNTING SYSTEM

(71) Applicant: R&BWagner, Inc., Butler, WI (US)

(72) Inventors: Alexander Seeboth, Cedarburg, WI (US); Michael MacLeish, Cedarburg, WI (US)

(73) Assignee: R&B Wagner, Inc., Butler, WI (US)

( * ) Notice: Subject to any disclaimer, the term of this patent is extended or adjusted under 35 U.S.C. 154(b) by 0 days.

(21) Appl. No.: 17/247,286

(22) Filed: Dec. 7, 2020

(65) Prior Publication Data

US 2021/0172178 A1 Jun. 10, 2021

Related U.S. Application Data

(60) Provisional application No. 62/944,129, filed on Dec. 5, 2019.

(51) Int. Cl.
*E04F 11/18* (2006.01)
*E04B 2/74* (2006.01)

(52) U.S. Cl.
CPC ..... *E04F 11/1846* (2013.01); *E04B 2/7401* (2013.01); *E04F 11/1853* (2013.01); *E04F 2011/1895* (2013.01)

(58) Field of Classification Search
CPC . E04F 11/181; E04F 11/1846; E04F 11/1853; E04F 11/1851; E04F 11/1834;
(Continued)

(56) References Cited

U.S. PATENT DOCUMENTS 2,169,713 A 8/1939 Stroud
3,528,691 A 9/1970 Matich, Jr.
(Continued)

FOREIGN PATENT DOCUMENTS

CN 105003037 Y 10/2015
JP 2000-64732 2/2000

OTHER PUBLICATIONS

Search Report and Written Opinion for PCT Application No. PCT/US2008/064692 dated Sep. 29, 2008.
(Continued)

*Primary Examiner* — Kyle J. Walraed-Sullivan
(74) *Attorney, Agent, or Firm* — James A. Joyce; Godfrey & Kahn, S.C.

(57) ABSTRACT

A system for leveling and securing a partition, including a base or shoe for receiving the partition, and a channel or slot formed in the base by at least a first sidewall, an opposing second sidewall, and a lower wall positioned at least in part between the first and second sidewalls. The system further includes a rocker assembly and a clamp assembly positioned within the slot. The rocker assembly includes a stationary component positioned adjacent the first sidewall and a pivoting component pivotably connected to the stationary component on a side of the stationary component opposite the first sidewall. The clamp assembly may include a stationary block adjacent the second sidewall, a first sliding block slidably connected to the stationary block and adjustable by a first fastener, and a second sliding block slidably connected to the stationary block and adjustable by a second fastener.

14 Claims, 14 Drawing Sheets

(58) Field of Classification Search
CPC ..... E04F 2011/1895; E04F 2011/1823; E04B 2/7401; E04B 2/7416; E06B 3/54; E06B 3/5454; E06B 3/549
See application file for complete search history.

(56) References Cited

U.S. PATENT DOCUMENTS

| | | | | |
|---|---|---|---|---|
| 3,593,963 | A | 7/1971 | Horgan, Jr. | |
| 3,722,029 | A | 3/1973 | Horgan | |
| 4,054,268 | A * | 10/1977 | Sher | E04F 11/1812 256/24 |
| 4,103,874 | A | 8/1978 | Horgan, Jr. | |
| 4,381,578 | A | 5/1983 | Glejf | |
| 4,423,582 | A | 1/1984 | Yates | |
| 4,671,016 | A | 6/1987 | Boeckx | |
| 4,680,903 | A | 7/1987 | Horgan, Jr. | |
| 4,763,453 | A | 8/1988 | Horgan, Jr. | |
| 4,837,993 | A | 6/1989 | Studenski | |
| 4,920,717 | A | 5/1990 | Hooper, Jr. | |
| 5,069,010 | A | 12/1991 | Trainor, Jr. et al. | |
| 5,205,099 | A | 4/1993 | Gruenhage et al. | |
| 5,239,778 | A | 8/1993 | Towler | |
| 5,275,074 | A | 1/1994 | Taylor et al. | |
| 5,339,583 | A | 8/1994 | Hrdlicka et al. | |
| 5,444,958 | A | 8/1995 | Lu | |
| 6,419,209 | B1 | 7/2002 | Shepherd | |
| 6,434,905 | B1 | 8/2002 | Sprague | |
| 6,517,056 | B2 | 2/2003 | Shepherd | |
| 6,543,956 | B2 | 4/2003 | Schwarzbich | |
| 6,912,818 | B2 | 7/2005 | Sprague | |
| 7,036,799 | B2 | 5/2006 | Shepherd | |
| 7,272,913 | B2 | 9/2007 | Mitchell | |
| 7,380,378 | B2 | 6/2008 | Clifford et al. | |
| 7,434,790 | B1 | 10/2008 | Hansen | |
| 7,454,867 | B2 | 11/2008 | Bruno | |
| 7,516,583 | B2 | 4/2009 | Mitchell | |
| 7,584,588 | B2 | 9/2009 | Kim | |
| 7,614,191 | B2 | 11/2009 | Mitchell | |
| 7,624,549 | B2 | 12/2009 | Kopish | |
| 7,730,682 | B2 | 6/2010 | Nash | |
| 7,963,077 | B2 * | 6/2011 | Lin | E06B 3/72 52/204.597 |
| 8,181,405 | B2 | 5/2012 | Nash | |
| 2002/0195595 | A1 | 12/2002 | Shepherd | |
| 2003/0024182 | A1 | 2/2003 | Yeany | |
| 2006/0070318 | A1 | 4/2006 | Chen et al. | |
| 2009/0241445 | A1 | 10/2009 | Sprague | |
| 2010/0307082 | A1 * | 12/2010 | Nash | E04F 11/1851 52/238.1 |
| 2013/0248792 | A1 * | 9/2013 | Bangratz | E04F 11/1851 256/24 |
| 2015/0110552 | A1 * | 4/2015 | Yang | E04F 11/1812 403/374.1 |
| 2015/0240851 | A1 | 8/2015 | Giacometti et al. | |
| 2015/0267415 | A1 * | 9/2015 | Zhou | E04F 11/1812 52/208 |
| 2015/0330562 | A1 * | 11/2015 | Bonomi | F16M 13/022 248/558 |
| 2016/0265232 | A1 * | 9/2016 | Noble | E04F 11/1834 |
| 2016/0281366 | A1 * | 9/2016 | Spence | E04F 11/1817 |
| 2016/0298337 | A1 * | 10/2016 | Header | E04F 11/1812 |
| 2016/0298375 | A1 | 10/2016 | Wagner et al. | |
| 2017/0101784 | A1 * | 4/2017 | Gonzato | E04F 11/1853 |
| 2018/0135669 | A1 * | 5/2018 | Dagand | E04F 11/1853 |
| 2019/0177973 | A1 * | 6/2019 | Mitrovic | E04B 2/7401 |
| 2020/0087919 | A1 * | 3/2020 | Ravan | E04F 11/1812 |

OTHER PUBLICATIONS

Search Report and Written Opinion for PCT Application No. PCT/US2020/70868 dated Mar. 12, 2021.

* cited by examiner

LEVELING PARTITION MOUNTING SYSTEM

CROSS REFERENCE TO RELATED APPLICATION

This application claims the benefit of U.S. Provisional Patent Application Ser. No. 62/944,129, filed Dec. 5, 2019, which is incorporated herein by reference in its entirety for all purposes.

FIELD OF THE INVENTION

The present disclosure relates generally to mounting systems and clamp assemblies for mounting partitions.

BACKGROUND

It is conventional to use various types of panes to form a partition in a guard rail, hand rail, railing for a stair or walkway, barrier, or pedestrian control structure. To mount these partitions securely without damaging the pane itself has always been an issue with installation of such partitions. In addition, it may be desirable to provide for removal of the partition, without damaging the pane, for repair or replacement at some future date.

Conventional systems for installing and removably securing partitions in such applications are shown in U.S. Pat. No. 7,730,682, and in U.S. Pat. No. 8,181,405, the disclosures of which are incorporated herein by reference.

Improvements to the above-referenced systems and other known approaches to installing and removably securing partitions are desirable.

SUMMARY OF THE INVENTION

A certain aspect of the present invention provides a system for mounting a partition. In this aspect, the system is configured to level and securely mount the partition. Accordingly, in one embodiment, the present invention provides a system for leveling and removably securing a partition, the system comprising a base, a rocker assembly, and a clamp assembly. The base includes a first sidewall, a second sidewall that opposes the first sidewall, and a lower wall positioned at least in part between the first sidewall and the second sidewall. At least the first sidewall, the second sidewall, and the lower wall form a slot sized to receive the partition. The rocker assembly includes a stationary component positioned adjacent the first sidewall and a pivoting component pivotably mated to the stationary component. Lastly, the clamp assembly includes a stationary block positioned adjacent the second sidewall, aligned at least in part with the rocker assembly. A first sliding block and a second sliding block each connect to the stationary block in a manner that permits sliding with respect to the stationary block. The clamp assembly also includes a first fastener, a second fastener, a first fastener receiving element, and a second fastener receiving element. The first fastener includes a first fastener head that bears at least partially on a portion of the first sliding block and a first fastener threaded portion connected to the first fastener head. The first fastener receiving element is positioned at least partially within the stationary block and configured to receive the first fastener threaded portion. The second fastener includes a second fastener head that bears at least partially on a portion of the stationary block and a second fastener threaded portion connected to the second fastener head. The second fastener receiving element is positioned at least partially within the second sliding block and is configured to receive the second fastener threaded portion.

Another aspect of the invention provides another system for leveling and removably securing a partition, the system comprising a shoe channel, a rocker assembly, and a clamp assembly spaced apart from the rocker assembly. The shoe channel is comprised of at least a first sidewall, a second sidewall opposite the first sidewall, and a lower face separating the first sidewall from the second sidewall. The rocker assembly includes a stationary component and a pivoting component. The stationary component connects to the first sidewall, and the pivoting component pivotably mates to the stationary component on a side of the stationary component opposite the sidewall. The pivoting component is configured to rest at least partially flush against an installed partition during operation. Finally, the clamp assembly includes a center block that is connected to the second sidewall and center-aligned with the pivoting component of the rocker assembly. The center block has an upper block coinciding face and a lower block coinciding face. The clamp assembly also includes an upper block and a lower block, each adjacent to the center block. The upper block has a center block coinciding face that permits sliding of the upper block with respect to the center block when the center block coinciding face is aligned with the upper block coinciding face. Likewise, the lower block has a center block coinciding face that permits sliding of the lower block with respect to the center block when the center block coinciding face is aligned with the lower block coinciding face. Further, the clamp assembly includes a first fastener, a first fastener receiving element, a second fastener, and a second fastener receiving element. The first fastener has a first fastener head that bears at least partially on a bearing surface of the upper block and a first fastener threaded portion that extends from the first fastener head. The first fastener receiving element is positioned at least partially within the center block and is configured to receive the first fastener threaded portion. The second fastener has a second fastener head that bears at least partially on a bearing surface of the center block and a second fastener threaded portion that extends from the second fastener head. The second fastener receiving element is positioned at least partially within the lower block and is configured to receive the second fastener threaded portion.

Yet another aspect of the invention provides a clamp assembly for securing a partition within a mounting system. The clamp assembly has a first block, a second block slidably connected to the first block, and a third block also slidably connected to the first block. The clamp assembly further includes a first fastener, a first fastener receiving element, a second fastener, and a second fastener receiving element. The first fastener has a first fastener head that bears at least partially on a portion of the first block and a first fastener threaded portion connected to the first fastener head. The first fastener receiving element is positioned at least partially within the second block and is configured to receive the first fastener threaded portion. The second fastener has a second fastener head that bears at least partially on a portion of the second block. The second fastener receiving element is positioned at least partially within the third block and is configured to receive the second fastener threaded portion.

Other objects and advantages of the present disclosure will become apparent hereinafter.

BRIEF DESCRIPTION OF THE DRAWINGS

The accompanying drawing figures, which are incorporated in and constitute a part of the description, illustrate several aspects of the invention and together with the description, serve to explain the principles of the invention. Though the terms "forward" and "rearward" are used throughout the written description to refer to the tilt direction of the partition secured within the described system, these terms are only used with reference to a particular view being shown in a particular figure, and are arbitrary beyond this context. A brief description of the figures is as follows.

DETAILED DESCRIPTION

Reference will now be made in detail to exemplary aspects of the system, which are illustrated in the accompanying drawings. Wherever possible, the same reference numbers will be used throughout the drawings to refer to the same or like parts.

Figure 1:
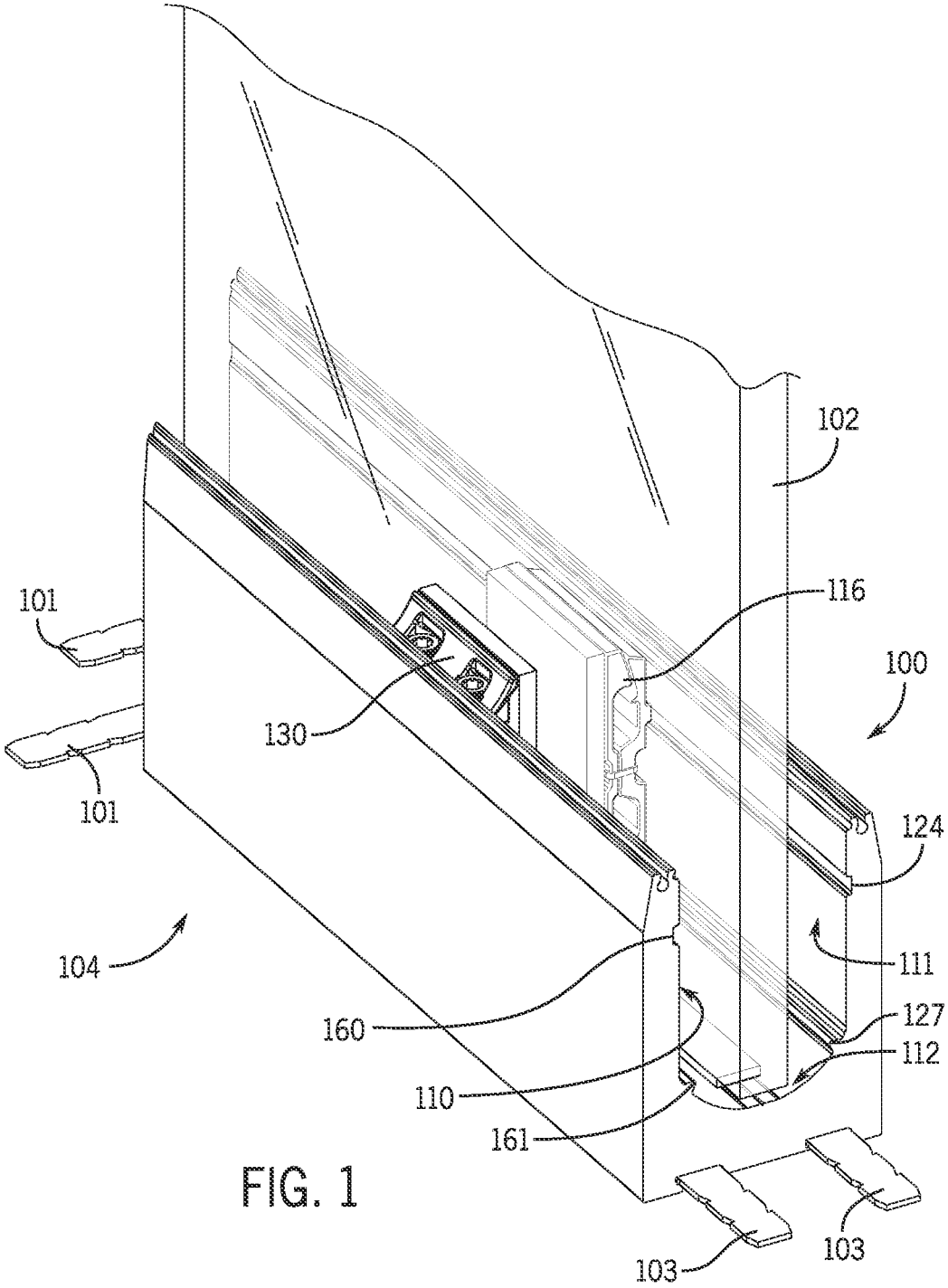
FIG. 1 is a top isometric view of a leveling partition mounting system, having a partition positioned therein, according to one embodiment of the present invention, the system gripping a partition in a fixed position.
Figure 1A:
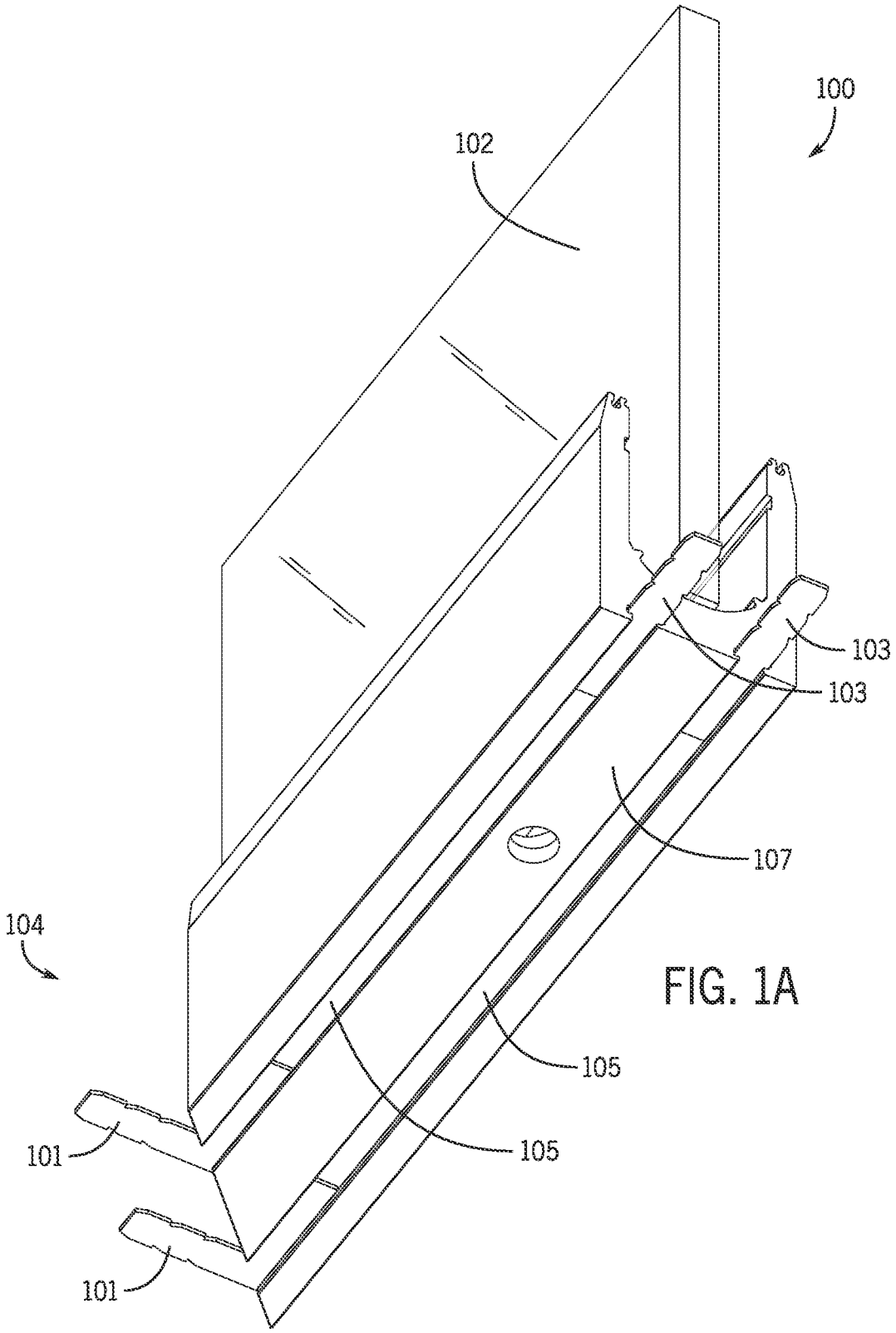
FIG. 1A is a bottom isometric view of the system and partition of FIG. 1
Figure 4:
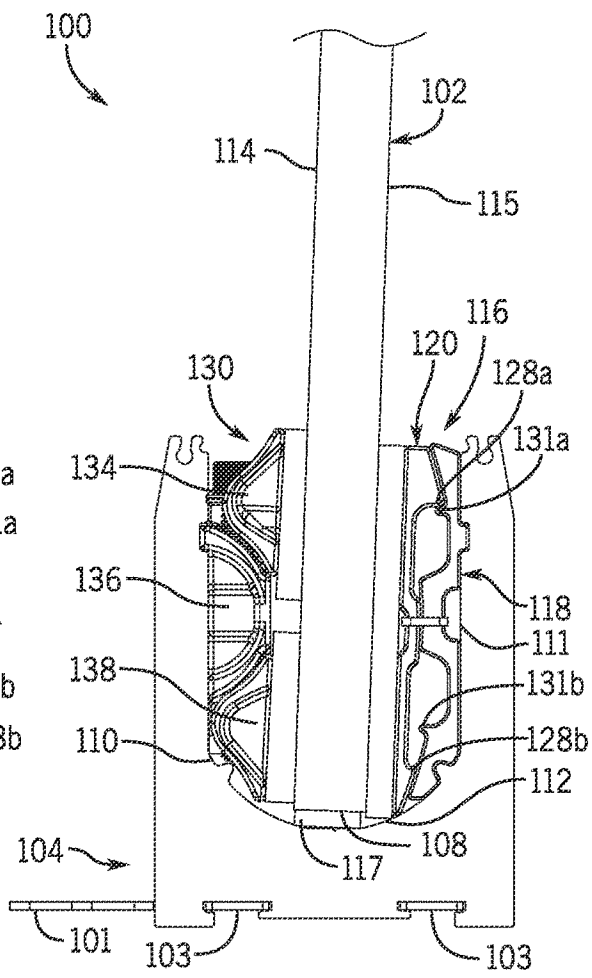
FIG. 4 is a schematic end view of the system and partition shown in FIG. 1, showing the partition in a fixed forward-tilted position.
Figure 5:
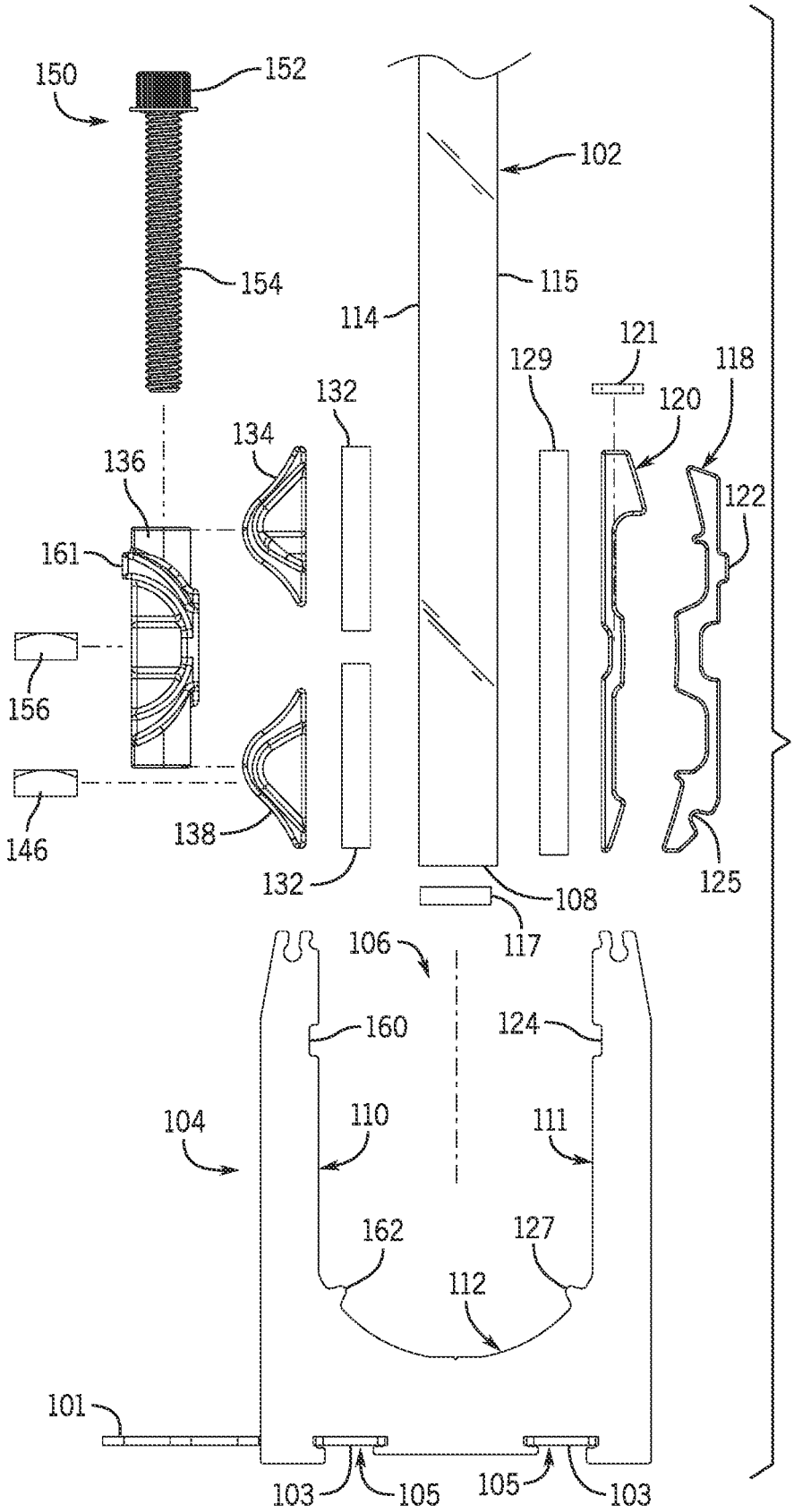
FIG. 5 in an exploded end view of the system and partition shown in FIG. 1. In this view, the additional fastener, shown in FIG. 1, is hidden behind the fastener shown. In this embodiment, the two fasteners are identical. Both fasteners can be seen in the view shown in FIG. 18 below.
Figure 8:
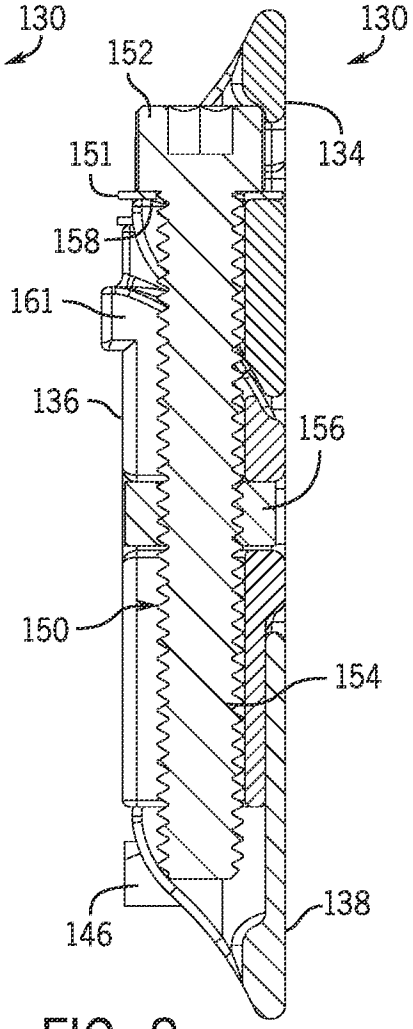
FIG. 8 is a sectional view of the clamp assembly shown in FIG. 6, taken along the line 8-8.
Figure 7:
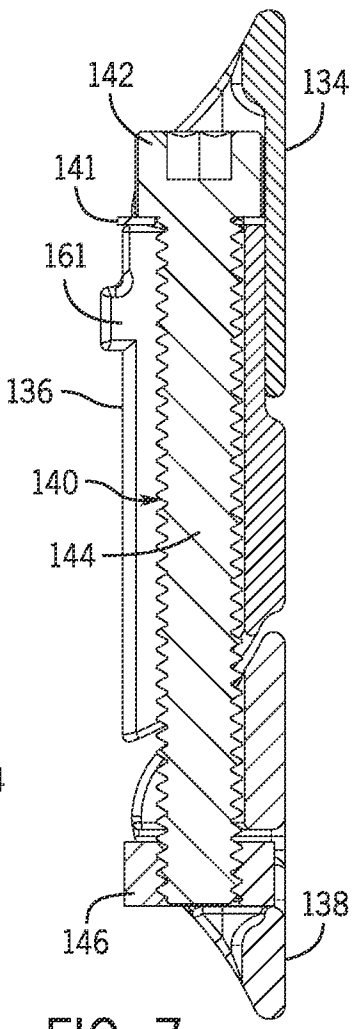
FIG. 7 is a sectional view of the clamp assembly shown in FIG. 6, taken along line 7-7.
Figure 6:
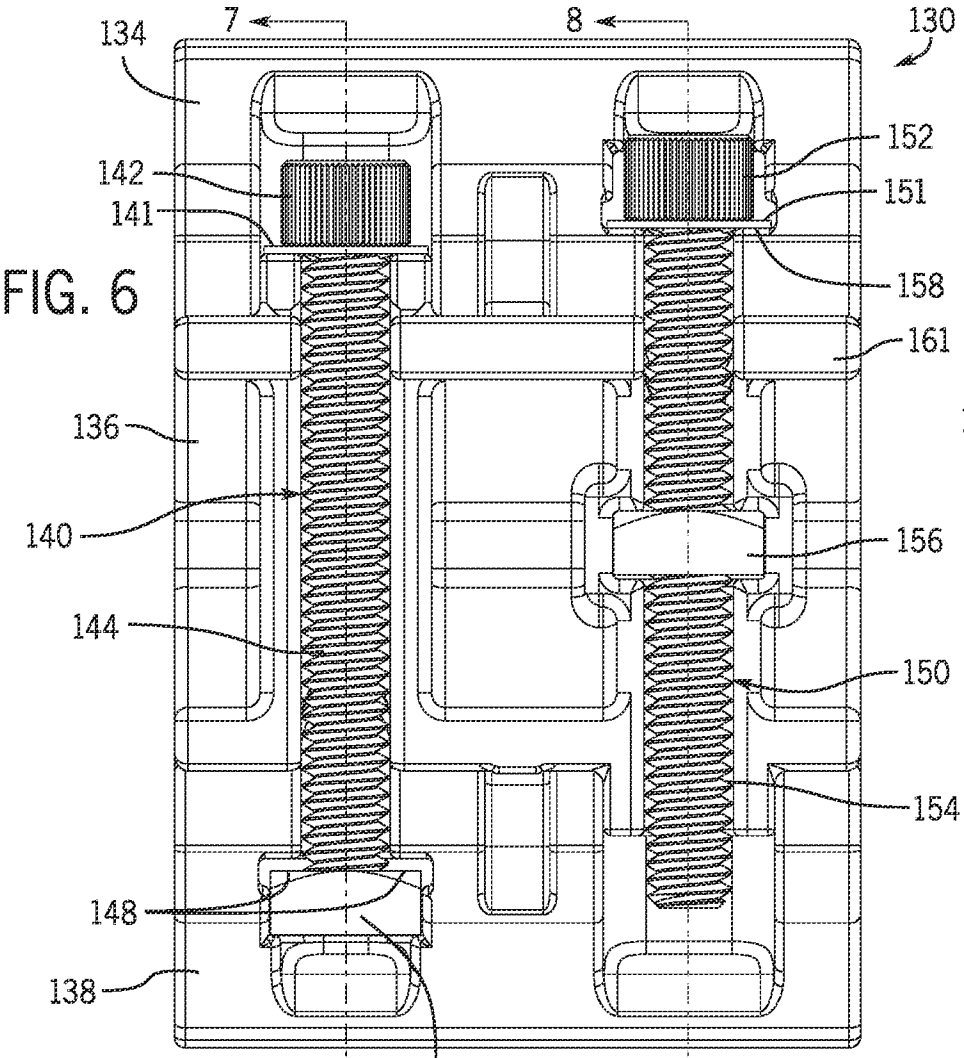
FIG. 6 is a front view of the clamp assembly of the system of FIG. 1, shown in an unengaged, neutral position.

Referring now to FIG. 1-21, a leveling partition mounting system 100 is illustrated for clamping a partition 102, such as for use in a handrail, guardrail or other railing system, or a barrier or pedestrian control system, into a base or shoe 104, using the rocker assembly 116 aligned with a clamp assembly 130 on an opposing side of the partition 102. In some instances, the partition 102 being secured by the system 100 will be a glass pane, though in other instances, the partition 102 may be formed of other firm materials. The rocker assembly 116 may include a stationary component 118 and a pivoting component 120, and the clamp assembly 130 may include an upper block 134, a center block 136, and a lower block 138, each of these components to be described in further detail below. In this embodiment, the center block 136 is center-aligned with the pivoting component 120. In some embodiments, spacer material may be inserted between the side 114 of the partition 102 and the clamp assembly 130 and/or between the side 115 of the partition 102 and the rocker assembly 116. Referring to FIG. 5, the spacer material may take the form of a single piece, such as the spacer material 129, shown between the rocker assembly pivoting component 120 and the partition side 115, or may be segmented into multiple, smaller pieces, such as the spacer materials 132, positioned between the individual clamp assembly blocks 134, 138, respectively, and the partition side 114. Spacer materials may run along the entirety of a given contact surface, or along portions thereof, and may extend beyond a given contact surface or not. The ability to add spacer materials of varying thicknesses expands the range of partition sizes that may be utilized with a single shoe profile and eliminates the need for asymmetric cladding, which some may consider visually unappealing. The spacer materials may be connected to the rocker assembly and/or clamp assembly using an adhesive or may be integrated as a part of the respective blocks 134 and 138 and/or the pivoting component 120. In certain embodiments, spacer materials may take the form of a stiff, yet compliant material, such as rubber, which may aid in gripping the partition and may further aid in isolating and protecting the partition from less compliant surfaces, such as the upper and lower blocks of the clamp assembly or the pivoting component of the rocker assembly, particularly in embodiments where these elements are comprised of metal and the partition is comprised of glass.

FIGS. 22-29 show an alternative embodiment, illustrating a system 200 for clamping a partition 202, using the rocker assembly 216 aligned with a clamp assembly 230 on an opposing side of the partition 202. In some instances, the partition 202 being secured by the system 200 will be a glass pane, though in some instances, the partition 202 may be formed of other firm materials. The rocker assembly 216 may include a stationary component 218 and a pivoting component 220, and the clamp assembly 230 may include an upper block 234, a center block 236, and a lower block 238, each of these components to be described in further detail below. In this embodiment, the center block 236 is center-aligned with the pivoting component 220. Here, a single piece of spacer material 229 is positioned between the partition side 215 and the rocker assembly 216, capable of functioning as described above. Though this embodiment does not show the use of segmented spacer materials, such spacer materials could likewise be utilized here.

Though the embodiments shown both illustrate the use of the rocker assembly and a clamp assembly, in alternative embodiments, the rocker assembly may be replaced with a second clamp assembly, and the system may utilize dual clamp assemblies to address unique leveling concerns that may require more dynamic adjustment options.

Referring to FIGS. 1-5, to aid in installation, some embodiments may include alignment aids, such as alignment tabs 101, 103, to align each section of shoe 104 with corresponding adjacent shoe sections. Here, the alignment tabs are formed of metal, though other materials are permissible, including but not limited to durable plastics. In this embodiment, alignment channels 105 are formed in the shoe 104 and are sized to receive alignment tabs 101, 103. If the adjacent shoe element forms a corner connection with the shoe 104, the alignment tabs may be angled, such as alignment tabs 101. Alternatively, if the adjacent shoe element forms an in-line connection, the alignment tabs may protrude straight from the alignment channels 105, such as alignment tabs 103. As a further alternative for aligning straight lines of shoe, the alignment channels 105 may accept round pins (not shown), in place of the alignment tabs 103. Though the above-described alignment elements are not required in every embodiment of the present invention (and, in fact, are not included in the embodiment shown in FIGS. 22-29), embodiments that utilize these alignment elements maintain a lower risk of misalignment. Without the alignment tabs 101, 103, it is easier for an installer to slightly misalign adjacent sections of the shoe during installation. Further, in this embodiment, the depth of the shoe is greater on the exterior side of each channel 105 and lesser on the interior side of each channel 105, presenting a raised surface 107 between the channels 105. Though such a raised surface is not required in all embodiments, in the embodiment shown here, raised surface 107 may serve to account for drainage, allow necessary clearance when mounting along an uneven surface such as, a surface containing loose debris, and/or aid in leveling the shoe, if necessary. In some instances, the raised surface can mate to an extruded molding for alignment, for modifying mounting angles, or for modifying mounting style, such as facia mounting.

In this embodiment, the shoe 104 is formed in a general U shape, defining a slot or channel 106 within which the partition 102 may be received. This U shape provides for more material to be present at the base, compared to the sides. Though such a design is not required in every embodiment, a design that provides for more material at the base decreases the likelihood of the base failing under load. The shape of the shoe 104 also permits for either hollow or solid extrusion. However, other shapes capable of providing the desired clamping force are also permissible. The shoe may be made of aluminum, although other stiff materials, including but not limited to durable plastics, may also be permissible. In certain embodiments, the material of the shoe may be prestressed. In this embodiment, the slot 106 is formed by a pair of opposing interior sidewalls 110, 111 and a lower face or wall 112. Here, the lower face 112 is curved into the depth of the shoe, though in other embodiments, like the embodiment shown in FIGS. 22-29, the lower face 212 may not include a substantial curve or may be curved in a different shape or to a different degree. In certain embodiments, to improve flexural strength, the interior sidewalls may be spaced closer together towards the bottom of the slot, narrowing the width of the slot at its closed end. In the embodiment shown in FIGS. 22-29, the shoe 204 is likewise formed in a general U shape, defining a slot 206, within which the partition 202 may be received. The slot 206 is formed by angled interior sidewalls 210, 211 and a generally flat lower face 212.

Referring to the embodiment shown in FIGS. 1-21, the partition 102 includes a pair of opposing sides 114, 115 adjacent a lower edge 108. At least a portion of the rocker assembly 116 may be positioned between the partition side 115 and the sidewall 111, and at least a portion of the clamp assembly 130 may be positioned between the partition side 114 and the sidewall 110. In some embodiments, like the one shown here, the stationary component 118 of the rocker assembly 116 may be mated to the sidewall 111 by one or more mating elements, such that the stationary component 118 is positioned directly adjacent to the sidewall 111. However, in other embodiments, stationary component 118 need not be directly adjacent to the sidewall 111; for instance, another element, such as a gripping, spacing, or other type of element, may be positioned in between.

Referring to FIG. 5, to effectuate the mating of the sidewall 111 with the stationary component 118, the sidewall 111 may include one or more sidewall mating elements, such as the indentation 124 and the protrusion 127, and the stationary component 118 may include one or more stationary component mating elements, such as the projection 122, corresponding to the indentation 124, and the indentation 125, corresponding to the protrusion 127. Further, the stationary block 136 of the clamp assembly 130 may be mated to the sidewall 110 by one or more mating elements, such that the stationary block 136 is positioned directly adjacent to the sidewall 110. However, in other embodiments, the stationary block 136 need not be directly adjacent to the sidewall 110; for instance, another element, such as a gripping, spacing, or other type of element, may be positioned in between. Similarly, to effectuate the mating of the sidewall 110 with the stationary block 136, the sidewall 110 may include one or more sidewall mating elements, such as the indentation 160 and the protrusion 162, and stationary block 136 may include one or more stationary block mating elements, such as the projection 161 corresponding to the indentation 160. The projection 161 may take the form of a single, continuous projection, or it may be broken into multiple segments as shown in this embodiment (see, for example, FIG. 6). The same is true of the other mating protrusions and indentations disclosed herein. Here, the mating of the stationary block 136 with the sidewall 110 fixes the stationary block 136 against substantial vertical displacement with respect to the sidewall 110. Similarly, the mating of the stationary component 118 with the sidewall 111, fixes the stationary component 118 against substantial vertical displacement with respect to the sidewall 111. In an alternative embodiment, the stationary component 118 and/or the stationary block 136 could be keyed and fixed into the shoe, formed as an integrated part of the shoe, or secured by another means that fixes against substantial vertical displacement.

In some embodiments, the shoe 104 may be formed symmetrically, such that the sidewall 110 mating elements, here the indentation 160 and the protrusion 162, may be capable of mating with the stationary component mating elements, here the projection 122 and the indentation 125, respectively, and the relevant sidewall 111 mating element, here indentation 124, may be capable of mating with the corresponding center block mating element, here projection 161. This symmetry allows flexibility as to the side of the partition 102 on which the adjustable clamp assembly 130 may be installed, in instances where it may be more convenient to make adjustments from one side of the partition 102 versus the other. However, in alternative embodiments, the shoe may be designed in an asymmetrical shape, for example, in a situation that calls for a narrower shoe, it may be preferable to form the rocker assembly as an integrated portion of the shoe, which could narrow the overall width of the shoe. Additionally, in some situations that call for more dynamic functionality of one assembly or the other, it may prove beneficial to, for instance, narrow the width of the sidewall 111 to provide for a wider rocker assembly where a greater degree of allowable tilt rotation is desired, or to narrow the sidewall 110 to provide for a wider clamp assembly where more dynamic clamping functionality is called for.

Figure 24:
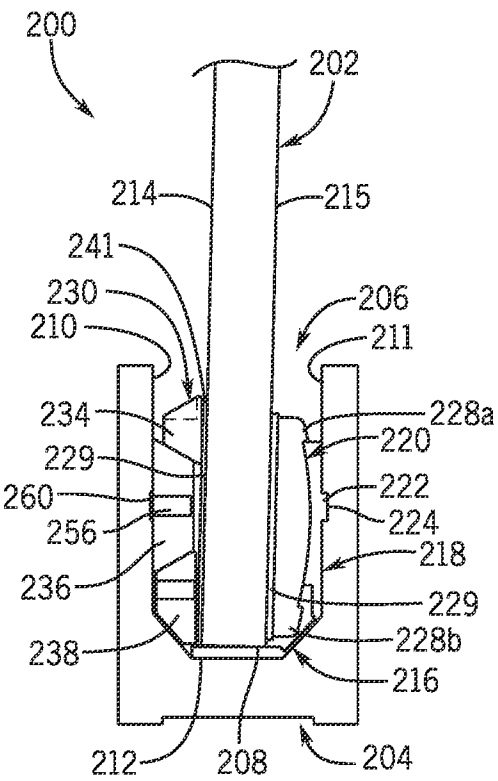
FIG. 24 is a schematic end view of the system and partition shown in FIG. 22, showing the partition in a fixed forward-tilted position.
Figure 23:
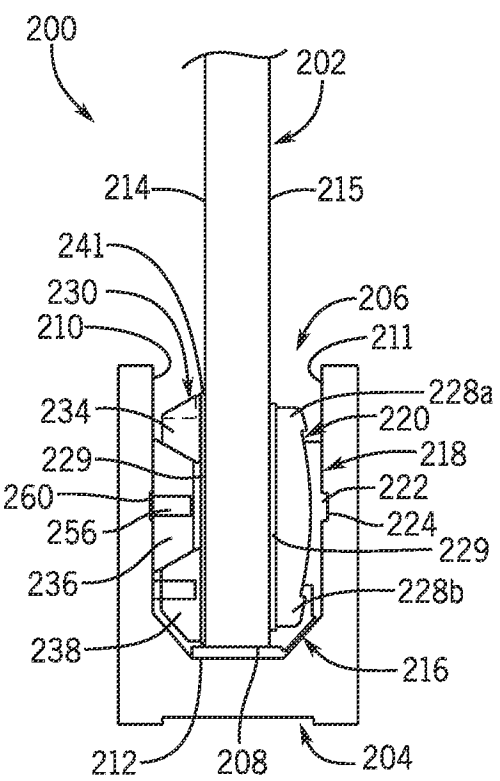
FIG. 23 is a schematic end view of the system and partition shown in FIG. 22, showing the partition in a fixed neutral position.
Figure 22:
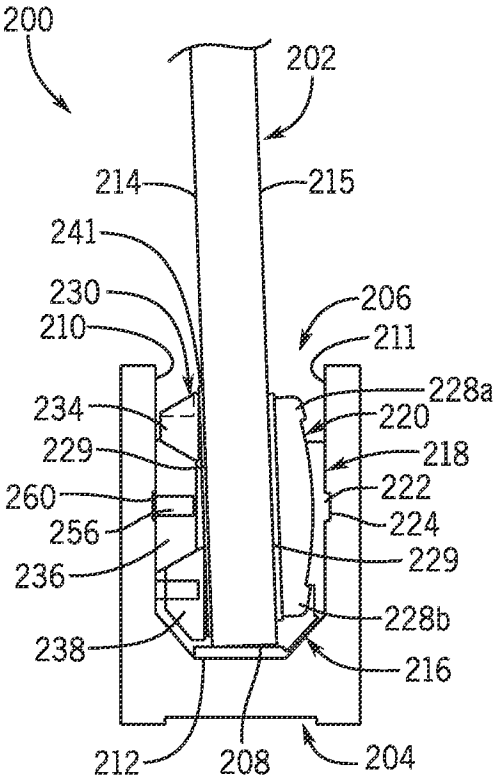
FIG. 22 is a schematic end view of a leveling partition mounting system according to a second embodiment of the present invention, the system securing a partition in a fixed, rearward-tilted position.

In the embodiment shown in FIGS. 22-29, the partition 202 includes a pair of opposing sides 214, 215, adjacent a lower edge 208. At least a portion of the rocker assembly 216 may be positioned between the partition side 215 and the sidewall 211, and at least a portion of the clamp assembly 230 may be positioned between the partition side 214 and the sidewall 210. In some embodiments, like the one shown here, the stationary component 218 of the rocker assembly 216 may be mated to the sidewall 211 by one or more mating elements, such that the stationary component 218 is positioned directly adjacent to the sidewall 211. However, in other embodiments, stationary component 218 need not be directly adjacent to the sidewall 211; for instance, another element, such as a gripping, spacing, or other type of element, may be positioned in between. Referring to FIGS. 22-24, to effectuate the mating of the sidewall 211 with the stationary component 218, the sidewall 211 may include one or more sidewall mating elements, such as the indentation 224, and the stationary component 218 may include one or more stationary component mating elements, such as the projection 222, corresponding to the indentation 224. Further, the stationary block 236 of the clamp assembly 230 may be mated to the sidewall 210 by one or more mating elements, such that the stationary block 236 is positioned directly adjacent to the sidewall 210. However, in other embodiments, the stationary block 236 need not be directly adjacent to the sidewall 210; for instance, another element, such as a gripping, spacing, or other type of element, may be positioned in between. Referring to FIGS. 22-24, to effectuate the mating of the sidewall 210 with the stationary block 236, the sidewall 210 may include one or more sidewall mating elements, such as the indentation 260, and stationary block 236 may include one or more stationary block mating elements, such as the nut 256, fitted within the center block 236 and corresponding to indentation 260. Here, the mating of the stationary block 236 with the sidewall 210 fixes the stationary block 236 against substantial vertical displacement with respect to the sidewall 210. Similarly, the mating of the stationary component 218 with the sidewall 211, fixes the stationary component 218 against substantial vertical displacement with respect to the sidewall 211. In an alternative embodiment, the stationary component 218 and/or the stationary block 236 could be keyed and fixed into the shoe, formed as an integrated part of the shoe, or secured by another means that fixes against substantial vertical displacement with respect to the sidewalls 210, 211.

Due to the symmetric nature of the shoe 204 in this embodiment, the indentation 260 may likewise be capable of mating with the projection 222, and the indentation 224 may be capable of mating with the nut 256. As in the embodiment discussed above, this symmetry allows flexibility as to the side of the partition 202 on which the adjustable clamp assembly 230 may be installed, in instances where it may be more convenient to make adjustments from one side of the partition 202 versus the other. In alternative embodiments, a greater or lesser number of mating elements may be used based on the securement needs of the system.

In some embodiments, as shown in FIGS. 2-5, a lower isolator pad 117 may be positioned between the lower face 112, and the lower partition edge 108. The thickness of the lower isolator pad 117 may vary from installation job to installation job, and one consideration in selecting the appropriate thickness may be the desired overall height to be achieved by the partition. The lower isolator pad 117 may be formed of a basic compliant material and in some embodiments, may include an LED strip for accent lighting. In the embodiment shown in FIGS. 1-5, the lower isolator pad 117 is segmented, though in other embodiments, it may be continuous. In some embodiments, the lower isolator pad 117 may be held in place by an adhesive or other permanent or semi-permanent method of securement, such as a groove formed in the lower face sized to mate with a gasket formed on the isolator pad. In other embodiments, the lower isolator pad 117 may be held in place by friction, without any other securement. Other means of securement not identified here are likewise permissible. In certain embodiments, such as the embodiment shown in FIGS. 22-24, a discrete lower isolator pad element may not be included at all, but rather, the isolating element beneath the partition may be an extension of the stationary rocker assembly component 218. In other embodiments, the isolating element could be an extension of the spacer material positioned between the partition 102 and the clamp assembly 130 and/or the spacer material positioned between the partition 102 and the rocker assembly 116.

Figure 21:
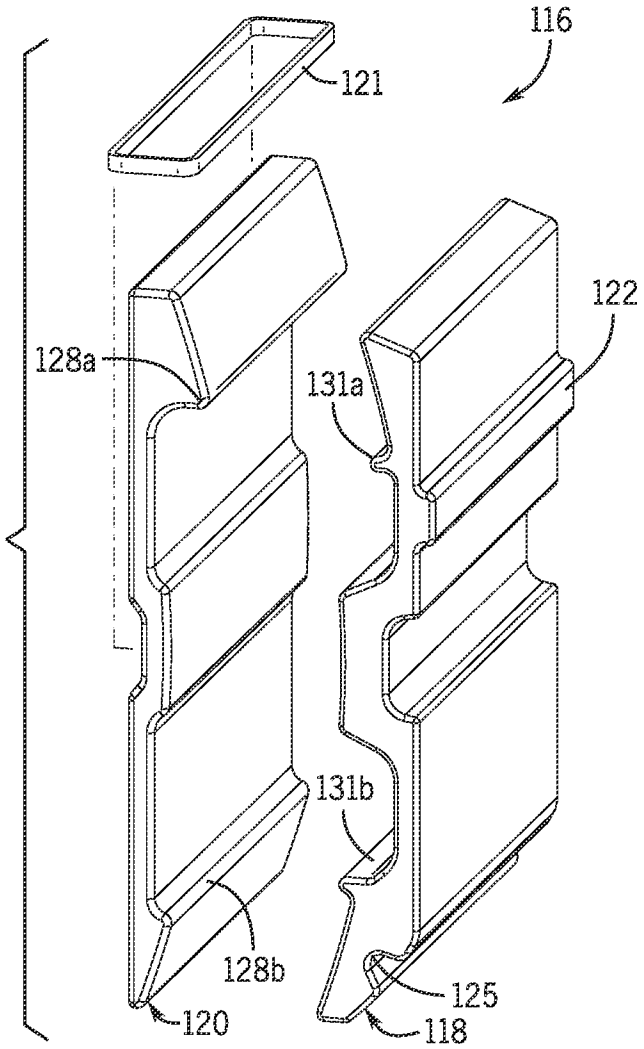
FIG. 21 is an exploded rear isometric view of the rocker assembly of the system of FIG. 1.
Figure 20:
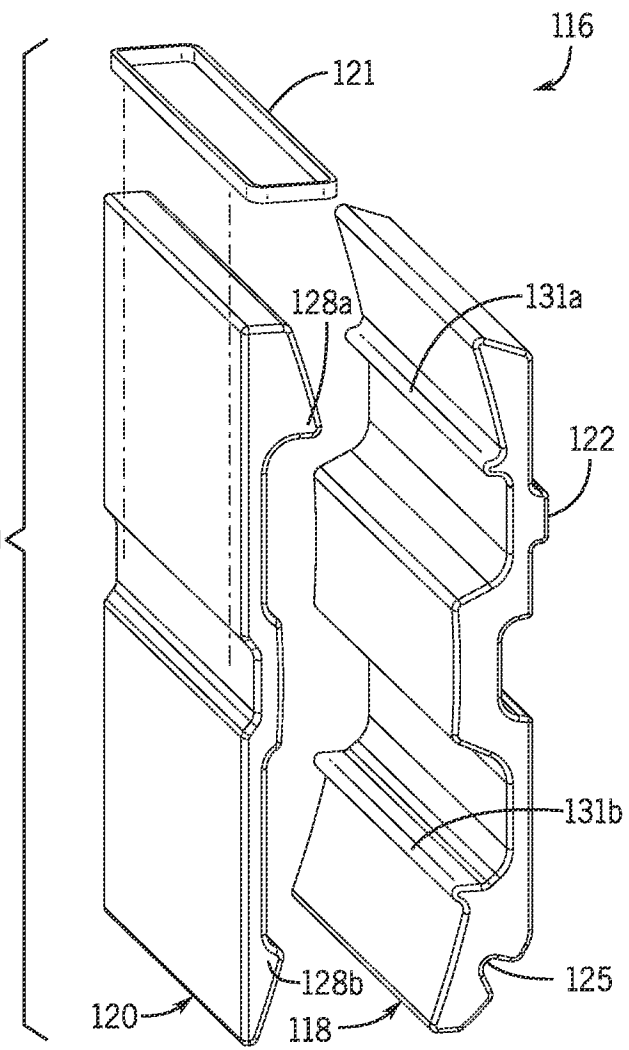
FIG. 20 is an exploded front isometric view of the rocker assembly of the system of FIG. 1.

Referring in particular to FIGS. 20-21, the rocker assembly 116 is shown in greater detail. The rocker assembly may be formed of metal, though other materials are permissible, including but not limited to durable plastics. As described above, the rocker assembly 116 may include a stationary component 118 that can be fixed against substantial vertical displacement during use and installation by mating the projection 122 and indentation 125 with the corresponding respective indentation 124 and protrusion 127 of the shoe sidewall 111. Though the use of dual pairs of mating elements is not required to secure the rocker assembly 116 (for example, only one pair of mating elements is used to secure the rocker assembly 216 in the embodiment shown in FIGS. 22-29), the additional pair of mating elements, located deeper within the slot 106 in this embodiment, may increase the stability of the rocker assembly 216 during installation of the partition 102. In this embodiment, the rocker assembly 116 further includes a pivoting component 120 that mates with the stationary component 118 in a manner that permits limited pivoting of the pivoting component 120 when pressure is applied by partition 102 during installation or adjustment. In this embodiment, the total rotation of the pivoting component 120 is limited to approximately +/− two degrees, i.e. a maximum rearward tilt of two degrees to a maximum forward tilt of two degrees. However, other embodiments may employ a broader or narrower range of rotation depending on the needs of the system.

The pivoting component 120 may include an upper stop tab 128*a* and a lower stop tab 128*b*, and the stationary component 118 may include an upper stop protrusion 131*a* and a lower stop protrusion 131*b*. In this embodiment, the range of pivoting motion is limited in the rearward tilt direction by the interaction between the lower stop tab 128*b* and the lower stop protrusion 131*b*, and, in the forward tilt direction, by the interaction between the upper stop tab 128*a* and the upper stop protrusion 131*a*, described in further detail below. The stop tabs 128*a*, 128*b* and stop protrusion 131*a*, 131*b* can operate to limit the throw of the partition 102, minimizing the chance of a person tipping the partition 102 excessively and falling over a barrier should the clamp assembly fail under a high load. The stop tabs 128*a*, 128*b* and stop protrusion 131*a*, 131*b* can also assist an installer in the secure installation of the partition, helping to ensure that the partition 102 maintains an orientation at which the clamp assembly 130 can achieve optimum clamping strength. Though the stop tabs 128*a*, 128*b* and stop protrusion 131*a*, 131*b* shown in this embodiment are formed as integrated parts of the pivoting component 120 and the stationary component 118, respectively, other alternatives are permissible to achieve the same functionality, for instance, discretely formed tabs attached to the respective surfaces of either the pivoting component 120 and/or the stationary component 118, for instance via an adhesive, or slots formed in the pivoting component into which stop tabs discrete from the pivoting component may be inserted, or, as shown in FIGS. 22-24 stop tabs formed on the pivoting component 220 stopped by contact with the overall body of the stationary component 218 itself, among other variations.

In the embodiment shown in FIGS. 1-21, the stationary component 118 and pivoting component 120 mate via concentric, curved surfaces, which are offset to avoid misassembly. Adding curvature to the mating surfaces reduces friction during sliding and allows for easier adjustment. In some embodiments, an elastic band, like the rubber band 121 shown in FIGS. 20-21, may be advantageous in maintaining the alignment of stationary component 118 and pivoting component 120 during installation. In other embodiments, other forms of alignment aids may be used, or no such aids may be used.

Referring to FIGS. 22-24, the rocker assembly 216 is shown in greater detail. Here, the rocker assembly 216 includes the stationary component 218, which can be fixed against substantial vertical displacement during use and installation by mating the projection 222 with the indentation 224 of the sidewall 211. Here, the rocker assembly 216 also includes the pivoting component 220. In this embodiment, the stationary component 218 includes a concave surface that mates with a convex surface of the pivoting component 220. In another embodiment, the mating surfaces may be reversed, with the stationary component 218 including the convex mating surface and pivoting component 220 including the concave mating surface. Further, in the present embodiment, an upper stop tab 228*a* and a lower stop tab 228*b* may be formed as integrated parts of the pivoting component 220.

Figure 18:
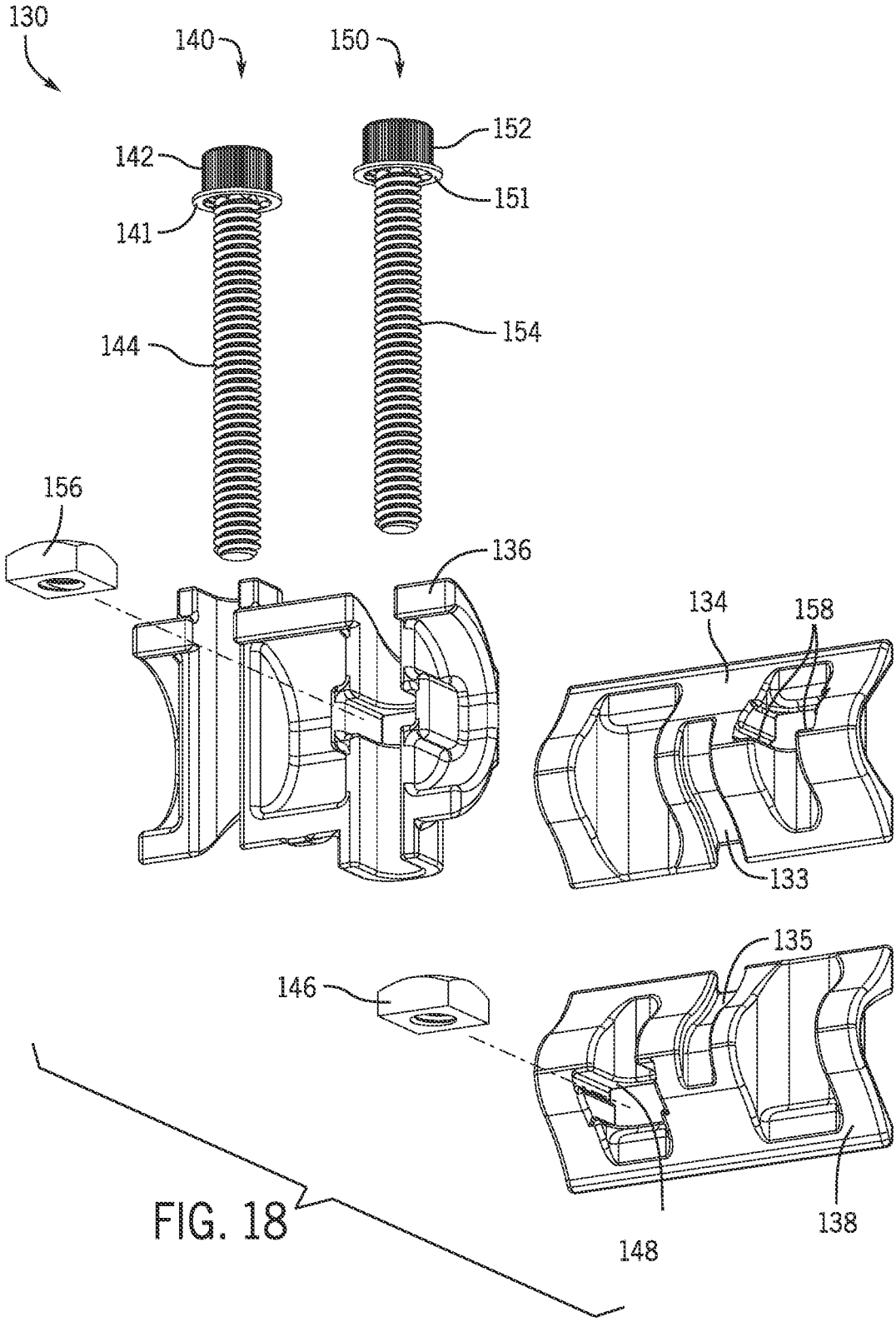
FIG. 18 is an exploded front isometric view of the clamp assembly of the system of FIG. 1.
Figure 19:
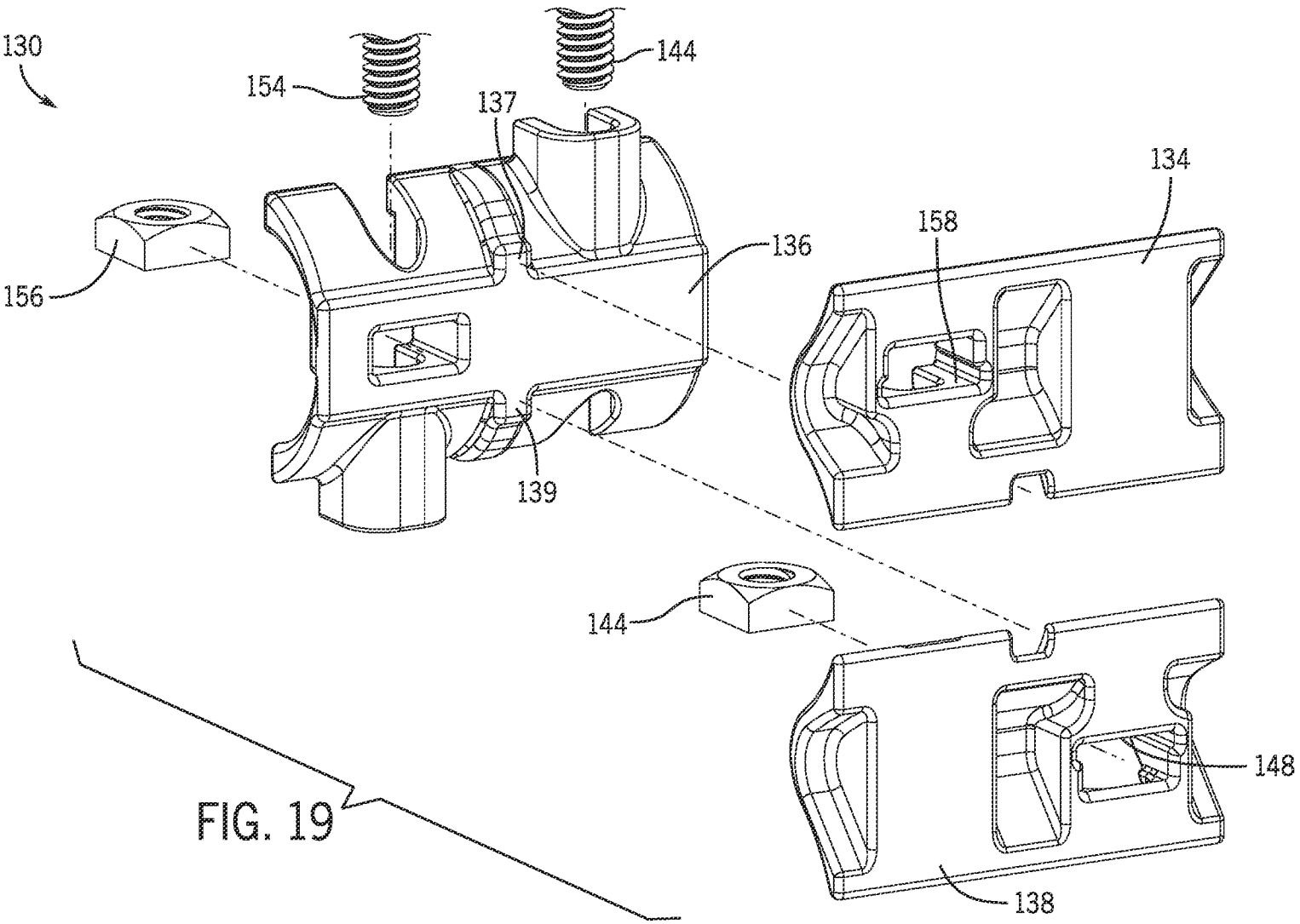
FIG. 19 is an exploded rear isometric view of the clamp assembly of the system of FIG. 1.

Referring to FIGS. 18-19, the clamp assembly 130 is shown in greater detail. Here, the clamp assembly 130 is configured to be selectively expandable to provide force against both sidewall 110 and the partition side 114 in order to secure the partition 102 within the shoe 104. As described above, clamp assembly 130 may include an upper block 134, a center block 136, and a lower block 138. The center block 136 is a stationary block, fixed at least against substantial vertical motion with respect to the sidewall 110, as described above. The upper block 134 and the lower block 138 are sliding blocks that each slide both laterally and vertically with respect to the center block 134. In this embodiment, the upper block 134 includes a curved center block coinciding face shaped to slide along a curved upper block coinciding face of the center block 136. The lower block 138 similarly includes a curved center block coinciding face shaped to slide along a curved lower block coinciding face of the center block 136. Though the coinciding faces of the clamp assembly blocks in this embodiment are curved, in other embodiments, any shape that permits the necessary sliding, such as the sloped, but generally uncurved, coinciding faces illustrated in the embodiment shown in FIGS. 22-24, is permissible.

The adjustable sliding of the upper and lower blocks 134, 138 with respect to the center block 136 allows for smooth insertion of partitions having a range of widths, in part due to allowable size tolerances associated with various partition materials. In this embodiment, the coinciding curvature along the center block 136, where the center block interacts with the coinciding faces of the upper block 134 and the lower block 138, respectively, provides for progressing clamping sensitivity, meaning that initial adjustments will provide more horizontal action of the upper block 134 and the lower block 138, respectively, than later adjustments, and thus, horizontal action will become finer the further the respective upper or lower block is moved in the direction of the partition 102. In some embodiments, the upper block 134 may be spaced the maximum allowable distance from the lower block 138 while still being contained in the slot 106. This can allow the contact surface area of the upper block 134 and lower block 138 to be maximized, increasing holding power for securing the partition 102.

Referring to FIGS. 18-19, the upper block 134 may include a guide channel 133 that may mate with a guide rib 137 protruding from the center block 136, and the lower block 138 may likewise include a guide channel 135 that may mate with a guide rib 139 protruding from the center block 136. The mating of the guide ribs 137, 139 with the guide channels 133, 135 during installation and use works to prevent the upper and lower blocks 134, 138 from twisting under applied clamping forces. In this embodiment, the upper block 134 is formed identically to the lower block 138, though the two blocks are positioned in opposing or reversed orientations with respect to the center block 136. In other embodiments, such as the embodiment shown in FIGS. 22-29, the upper and lower blocks need not be identically formed.

Abutting sides of the center block 136 and the lower block 138 may have coincidingly curved or sloped faces, such that the lower block 138 may slide with respect to a corresponding face of the center block 136 in a direction that is angled upward but also laterally toward the partition 102. In a similar manner, abutting sides of the center block 136 and upper block 134, may be coincidingly curved or sloped, such that the upper block 134 may slide with respect to center block 136 in a direction that is angled downward but also laterally toward the partition 102. The ability of the upper block 134 and lower block 138 to displace horizontally allows for smooth insertion of partitions having a range of widths, in part due to allowable size tolerances associated with various partition materials. In this embodiment, the curvature along the center block 136, where the center block interacts with the upper block 134 and the lower block 138, respectively, provides for progressing clamping sensitivity, meaning that initial adjustments will provide more horizontal action of the upper block 134 and the lower block 138, respectively, than later adjustments, and thus, horizontal action will become finer the further the respective upper or lower block is moved in the direction of the partition 102. While this form of curvature may prove beneficial in certain instances, it is not required in every embodiment, and other embodiments may utilize other forms of coinciding surfaces that permit sliding. For instance, the embodiment shown in FIGS. 22-29 employs sloped coinciding surfaces that are generally flat.

In this embodiment, as shown in FIGS. 5-19, a fastener 140, positioned in a generally vertical orientation, dynamically connects the center block 136 to the lower block 138. In alternative embodiments, such as the embodiment shown in FIGS. 22-29, a shorter fastener may be used, the head of which may be positioned deeper within the center block 136, though such a construction may require an adjustment tool with an adjustment element of sufficient length to reach the deeper-displaced fastener. The fastener 140 includes a head 142 and a threaded portion 144. The fastener 140 may be inserted through the upper block 134, such that it may be positioned, and then accessed, from above. The ability to access the fastener 140 from above allows for easy access to tighten the clamp assembly 230 upon installation, as well as to loosen the clamp assembly when need arises to repair or replace at least a portion of the partition 202. The threaded portion 144 may engage with a fastener receiving element or nut 146, such as a square nut, as shown in FIGS. 18-19, a hex nut, or any other suitable type of nut. The nut 146 is positioned within the lower block 138, such that the nut 146 is accessible from above by the threaded portion 144, but secured against rotation about the longitudinal axis of the threaded portion. Thus, when the fastener 140 is rotated, for instance by an Allen wrench or other form of rotating or ratcheting type tool, the nut 146 is raised along the threaded portion 144. The nut 146 bears at least partially on a bearing surface 148 of the lower block 138, such that the lower block 138 is raised as the nut 146 is raised, as shown in FIGS. 9-10 and 12-13. In the embodiment shown, the lower block 138 may displace up to approximately 0.2 inches in a generally horizontal direction during raising. However, other displacement ranges are permissible. In alternative embodiments, rather than being provided with a loose nut to be fitted within the lower bock upon assembly, the fastener receiving element could be provided by a threaded bore for accepting the fastener being formed directly in the lower block itself, or the nut could be crimped into the lower block for securement, among other alternatives.

Figures 9, 10, 11:
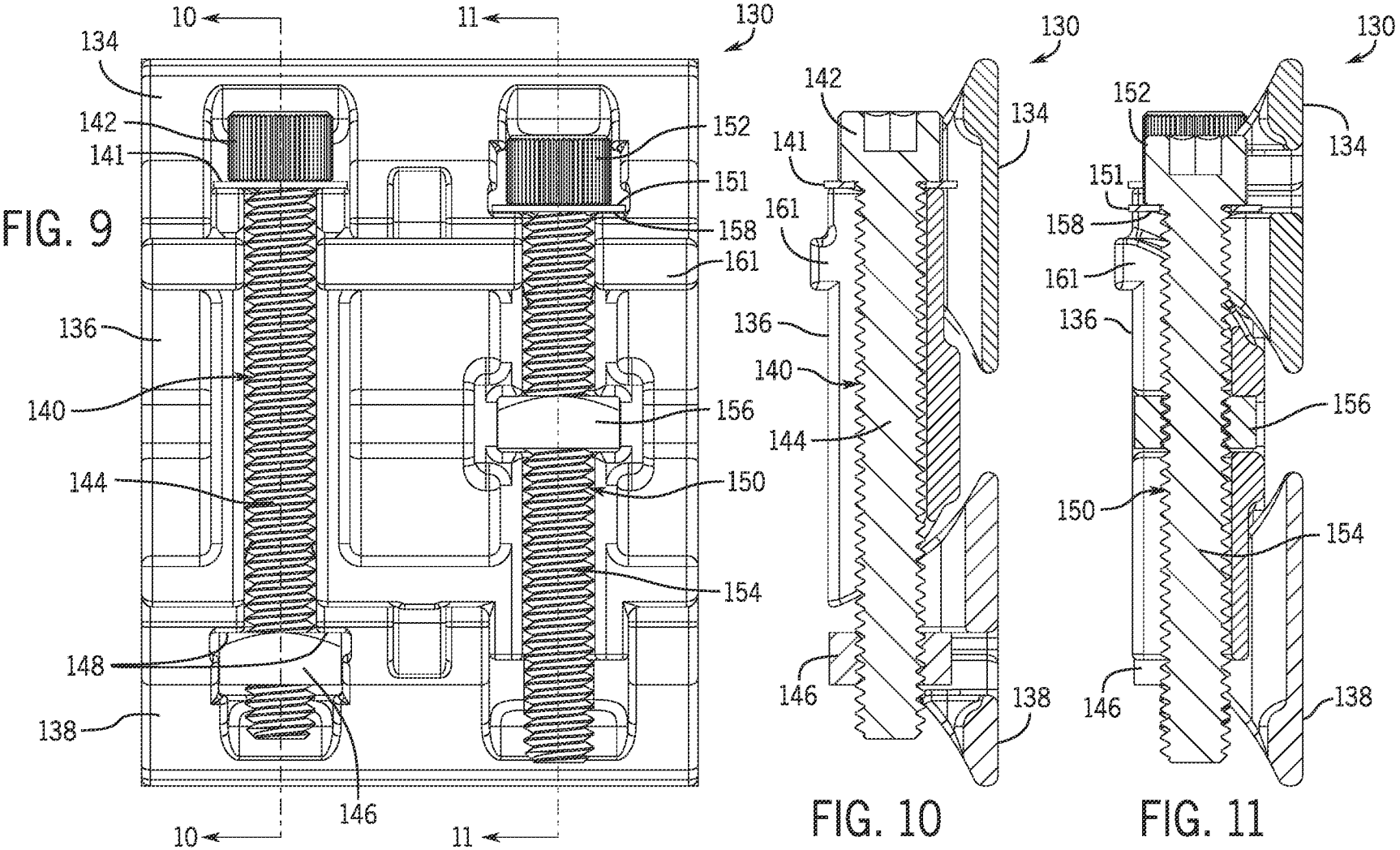
FIG. 9 is a front view of the clamp assembly of FIG. 6, shown in an engaged, neutral position.
FIG. 10 is a sectional view of the clamp assembly shown in FIG. 9, taken along line 10-10.
FIG. 11 is a sectional view of the clamp assembly shown in FIG. 9, taken along the line 11-11.
Figure 14:
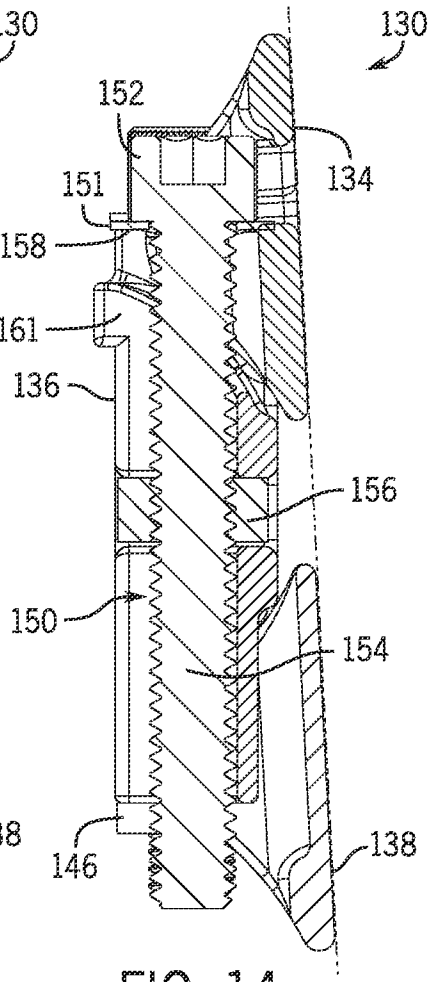
FIG. 14 is a sectional view of the clamp assembly shown in FIG. 12, taken along the line 14-14.
Figure 13:
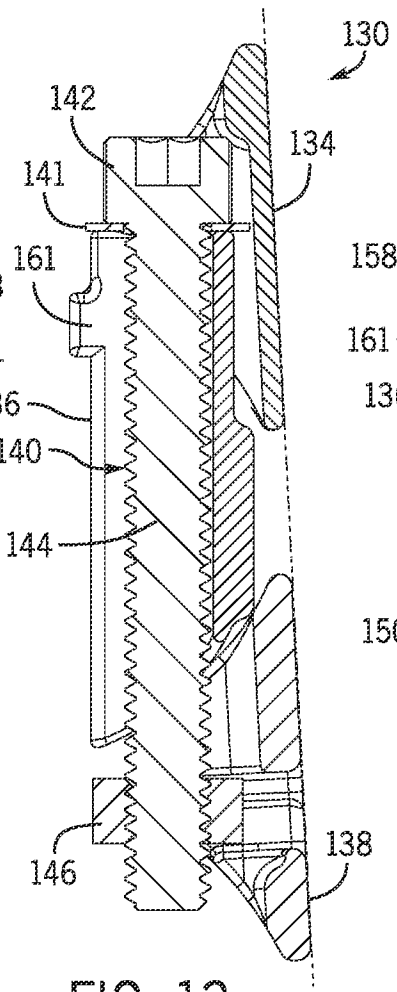
FIG. 13 is a sectional view of the clamp assembly shown in FIG. 12, taken along line 13-13.
Figure 12:
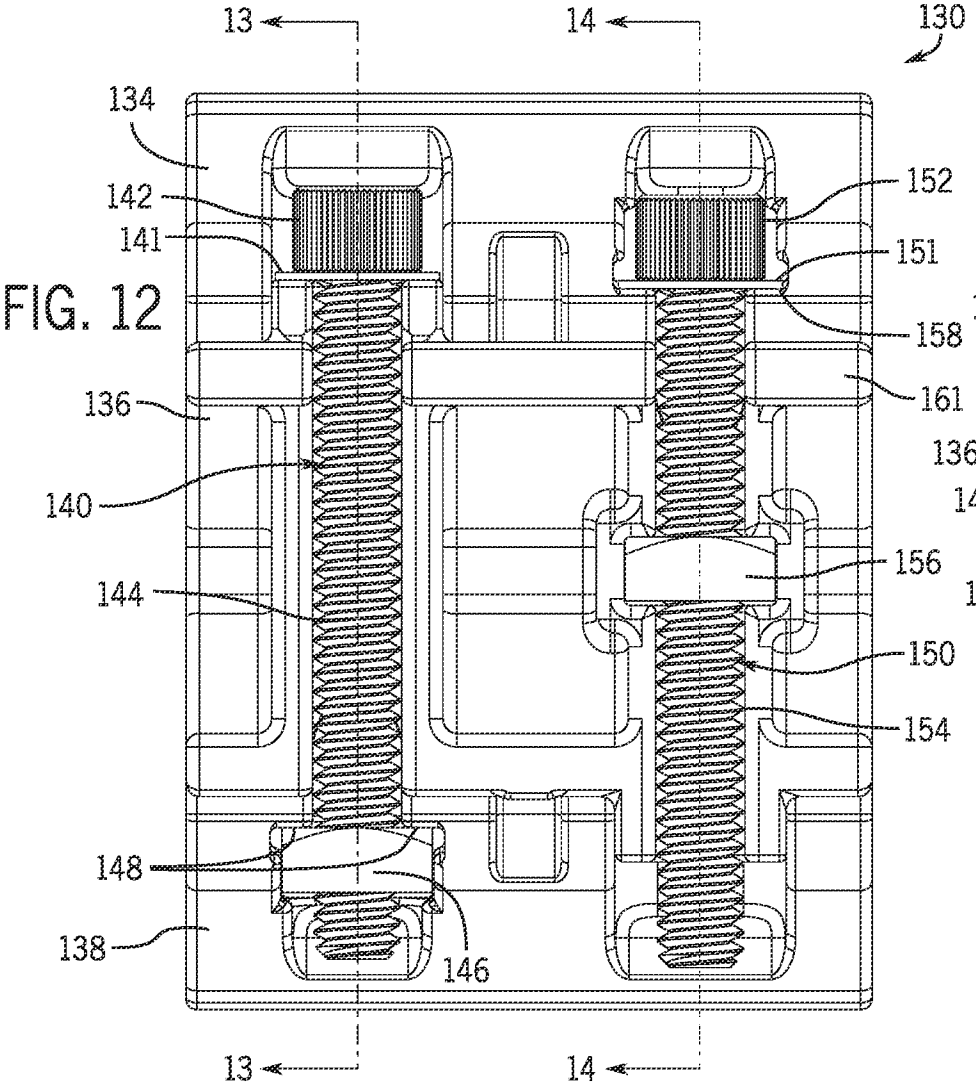
FIG. 12 is a front view of the clamp assembly of FIG. 6, shown in an engaged, rearward-tilt position.
Figures 15, 16, 17:
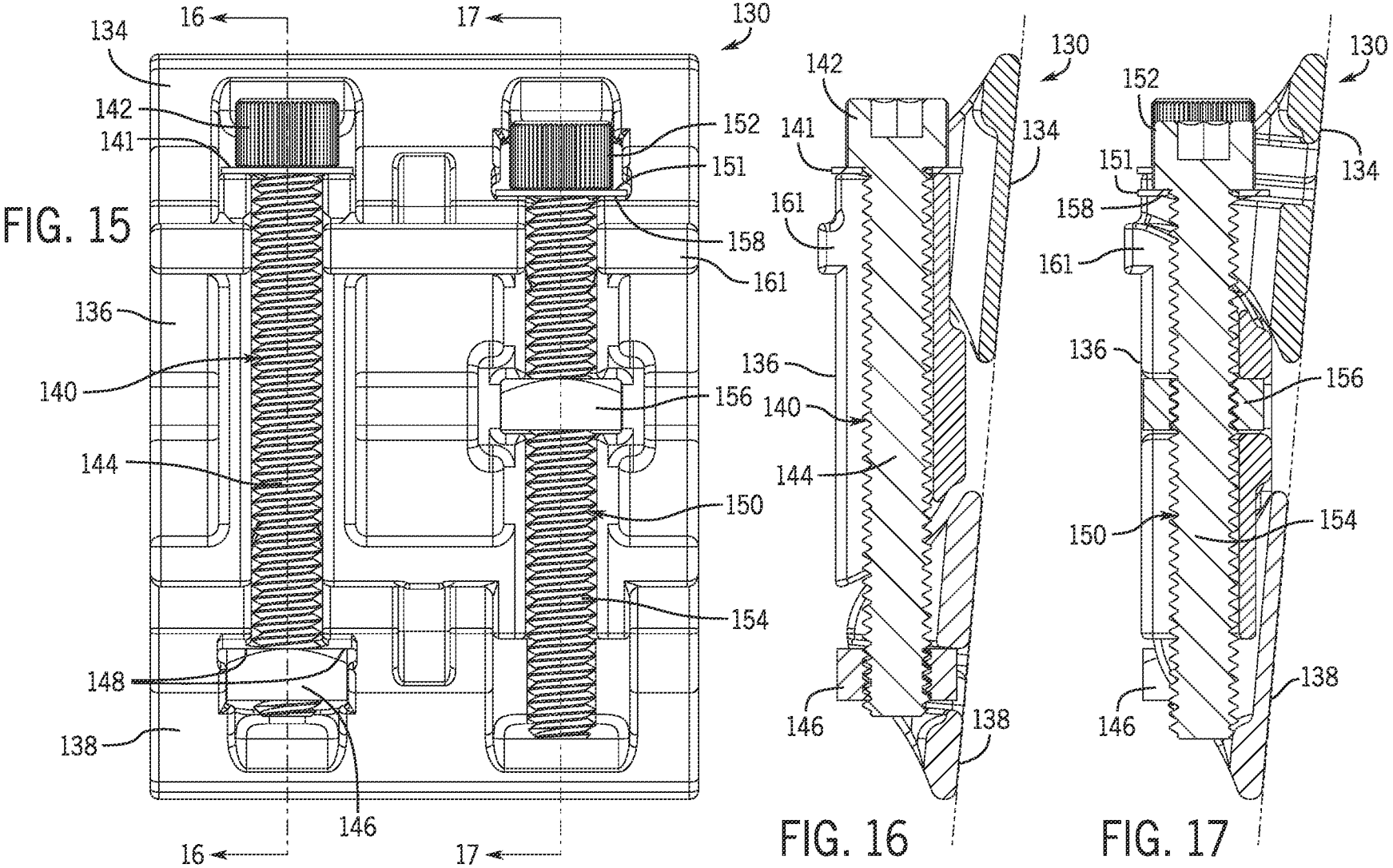
FIG. 15 is a front view of the clamp assembly of FIG. 6, shown in an engaged, forward-tilt position.
FIG. 16 is a sectional view of the clamp assembly shown in FIG. 15, taken along line 16-16.
FIG. 17 is a sectional view of the clamp assembly shown in FIG. 15 taken along the line 17-17.

Further, this embodiment includes a fastener 150, positioned in a generally vertical orientation, that dynamically connects the upper block 134 to the center block 136. In some embodiments, as shown here, the fastener 150 may be of such a length to extend beyond the center block 136, and the lower block 138 may be formed to accept such a fastener 150. However, in other embodiments, a shorter fastener may be utilized that may not extend beyond the center block 136. The fastener 150 includes a head 152 and a threaded portion 154. The fastener 150 may be inserted into the upper block 134, such that it may be positioned, and then accessed, from above. The threaded portion 154 may engage with a fastener receiving element or nut 156, such as a square nut, as shown in FIGS. 18-19, a hex nut, or any other suitable type of nut. In the embodiment with the nut 156, the nut is positioned within the center block 136, such that the nut is accessible from above by the threaded portion 154, but secured against rotation about the longitudinal axis of the fastener 150 and against substantial vertical displacement with respect to the center block 136. Thus, when the fastener 150 is rotated, for instance by an Allen wrench or other form of rotating or ratcheting type tool, the threaded portion 154 is drawn downward through the nut 156. The head 152 may bear on at least a partial surface 158 of the upper block 134, such that the upper block is lowered and moved toward the partition 102 as the threaded portion 154 is lowered, as shown in FIGS. 9 and 11, and in FIGS. 15 and 17. In this embodiment, a washer 151 may be positioned between the head 152 and the surface 158. Here, the upper block 134 may displace up to approximately 0.2 inches in a generally horizontal direction during lowering. However, other displacement ranges are permissible. In alternative embodiments, rather than being provided with a loose nut to be fitted within the lower bock upon assembly, the fastener receiving element could be provided by a threaded bore for accepting the fastener being formed directly in the lower block itself, or the nut could be crimped into the center block for securement, among other alternatives. The use of adjustable fasteners 140, 150 in the clamp assembly 130 to effectuate clamping adjustments within the system 100 significantly minimizes partition installation times in comparison to the installation times associated with other mechanisms known in the prior art, such as wrench mechanisms.

Referring to FIGS. 22-29, the clamp assembly 230 is configured to be selectively expandable to provide force against both sidewall 210 and the partition side 214 to secure the partition 202 within the shoe 204. As described above, clamp assembly 230 may include an upper block 234, a center block 236, and a lower block 238. The center block 236 is a stationary block, fixed at least against substantial vertical motion with respect to the sidewall 210, as described above. The upper block 234 and the lower block 238 are sliding blocks that each slide both laterally and vertically with respect to the center block 234. In this embodiment, the upper block 234 includes a sloped center block coinciding face shaped to slide along a sloped upper block coinciding face of the center block 236. The lower block 238 similarly includes a sloped center block coinciding face shaped to slide along a sloped lower block coinciding face of the center block 236. In some embodiments, the upper block 234 may be spaced the maximum allowable distance from the lower block 238 while still being contained in the slot 206. This can allow the contact surface area of the upper block 234 and lower block 238 to be maximized, increasing holding power for securing the partition 202. A further means to increase the contact surface area against the partition may be to insert a stiff bodied plate 241 between the upper and lower blocks and the partition. Increasing the contact surface area of the partition may minimize flexure of the partition and transfer the more concentrated load to the shoe, rather than the partition.

Figure 25:
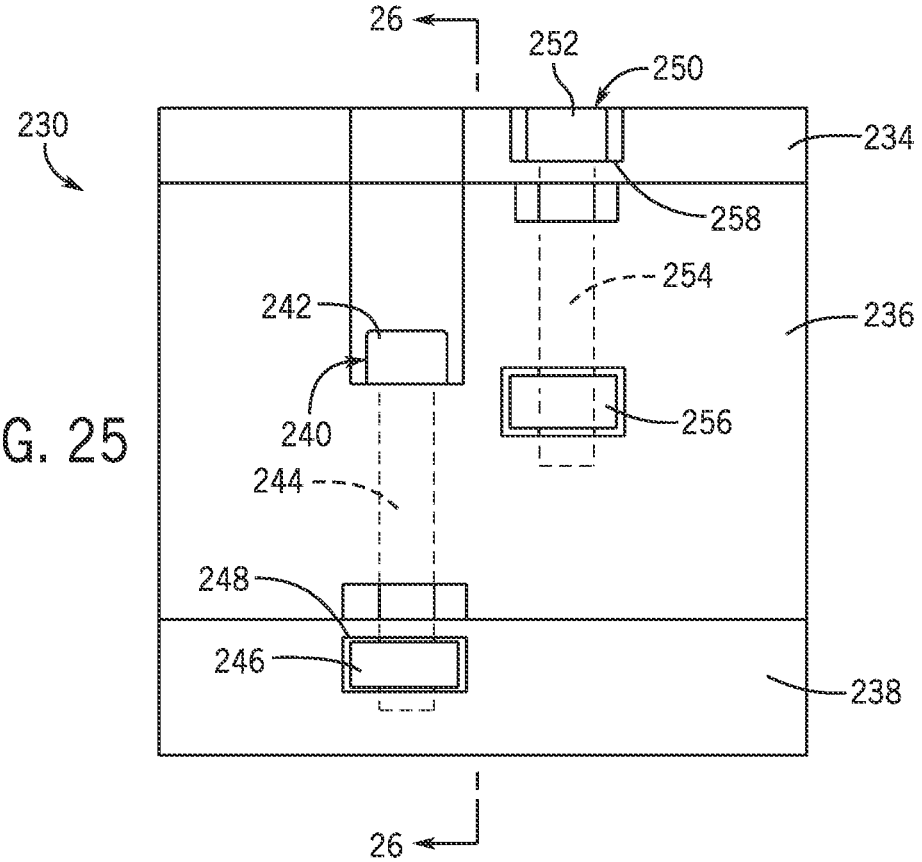
FIG. 25 is a schematic front view of the clamp assembly of the system shown in FIG. 22.
Figure 26:
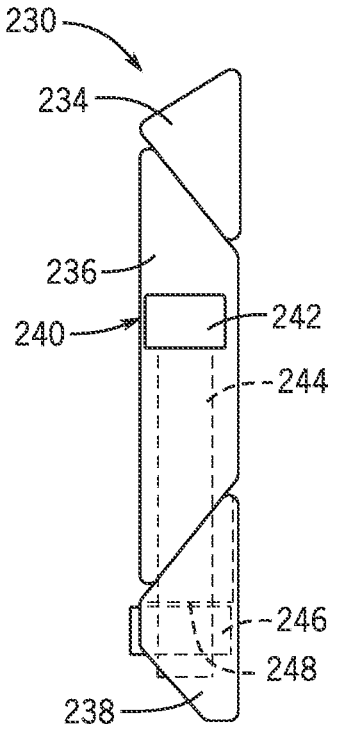
FIG. 26 is a schematic sectional view of the clamp assembly shown in FIG. 25, taken along line 26-26.
Figure 27:
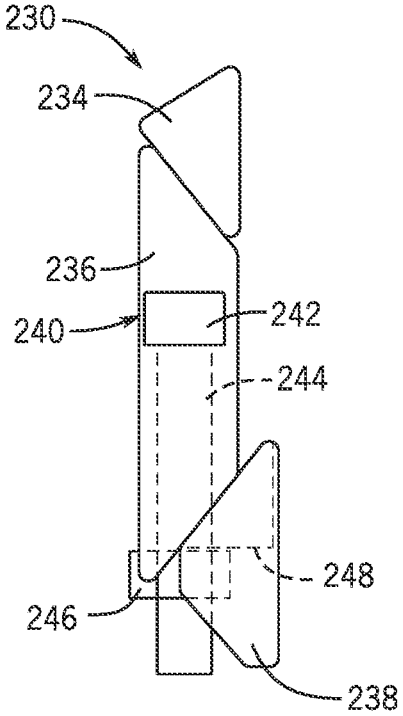
FIG. 27 is a schematic view of the clamp assembly section shown in FIG. 26 with the lower block of the clamp assembly moved into an upward position.

In this embodiment, as shown in FIGS. 25-27, a fastener 240, positioned in a generally vertical orientation, dynamically connects the center block 236 to the lower block 238. The fastener 240 includes a head 242 and a threaded portion 244. The fastener 240 may be inserted through the upper block 234, such that it may be positioned, and then accessed, from above. The ability to access the fastener 240 from above allows for easy access to tighten the clamp assembly 230 upon installation, and then also to loosen the clamp assembly when need arises to repair or replace at least a portion of the partition 202. The threaded portion 244 may engage with a fastener receiving element or nut 246, such as a square nut, as shown in FIGS. 18-19, a hex nut, or any other suitable type of nut. The nut 246 is positioned within the lower block 238, such that the nut 246 is accessible from above by the threaded portion 244, but secured against rotation about the longitudinal axis of the threaded portion. Thus, when the fastener 240 is rotated, for instance by an Allen wrench or other form of rotating or ratcheting type tool, the nut 246 is raised along the threaded portion 244. The nut 246 bears at least partially on a bearing surface 248, such that the lower block 238 is raised as the nut 246 is raised, as shown in FIG. 27. In one embodiment, the lower block 238 may displace up to approximately 0.2 inches in a generally horizontal direction during raising. However, other displacement ranges are permissible. In alternative embodiments, rather than being provided with a loose nut to be fitted within the lower bock upon assembly, the fastener receiving element could be provided by a threaded bore for accepting the fastener being formed directly in the lower block itself, or the nut could be crimped into the lower block for securement, among other alternatives.

Figure 28:
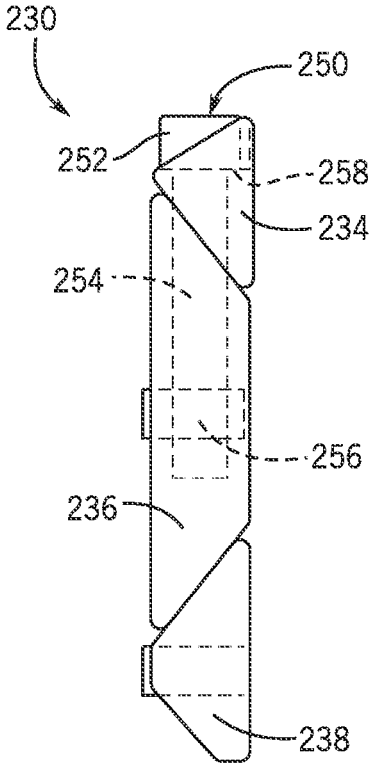
FIG. 28 is a schematic end view of the clamp assembly shown in FIG. 25. For purposes of clarity, the additional fastener (shown in FIGS. 26 and 27) is not shown here.
Figure 29:
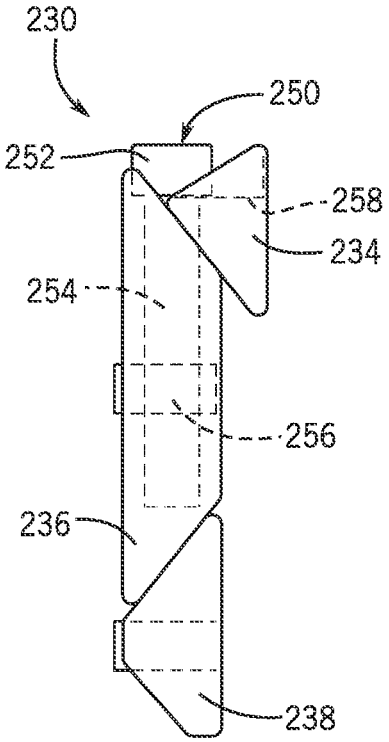
FIG. 29 is a schematic end view of the clamp assembly shown in FIG. 28 with the upper block of the clamp assembly moved into a downward position.

Further, in this embodiment, as shown in FIGS. 25 and 28-29, a fastener 250, positioned in a generally vertical orientation, dynamically connects the upper block 234 to the center block 236. The fastener 250 includes a head 252 and a threaded portion 254. The fastener 250 may be inserted into the upper block 234, such that it may be positioned, and then accessed, from above. The threaded portion 254 may engage with a fastener receiving element or nut 256, such as a square nut, as shown in FIGS. 18-19, a hex nut, or any other suitable type of nut. In the embodiment with the nut 256, the nut is positioned within the center block 236, such that the nut is accessible from above by the threaded portion 254, but secured against rotation about the longitudinal axis of the fastener 250 and against substantial vertical displacement with respect to the center block 236. Thus, when the fastener 250 is rotated, for instance by an Allen wrench or other form of rotating or ratcheting type tool, the threaded portion 254 is drawn downward through the nut 256. The head 252 bears on at least a partial surface 258 of the upper block 234, such that the upper block is lowered and moved toward the partition 202 as the threaded portion 254 is lowered, as shown in FIG. 29. In one embodiment, the upper block 234 may displace up to approximately 0.2 inches in a generally horizontal direction during lowering. However, other displacement ranges are permissible. In alternative embodiments, rather than being provided with a loose nut to be fitted within the lower bock upon assembly, the fastener receiving element could be provided by a threaded bore for accepting the fastener being formed directly in the lower block itself, and a projection such as the projection 161, shown in FIG. 5, could be employed to secure the center block 236 to the sidewall 210, or the nut could be crimped into the center block for securement, among other alternatives.

Figure 3:
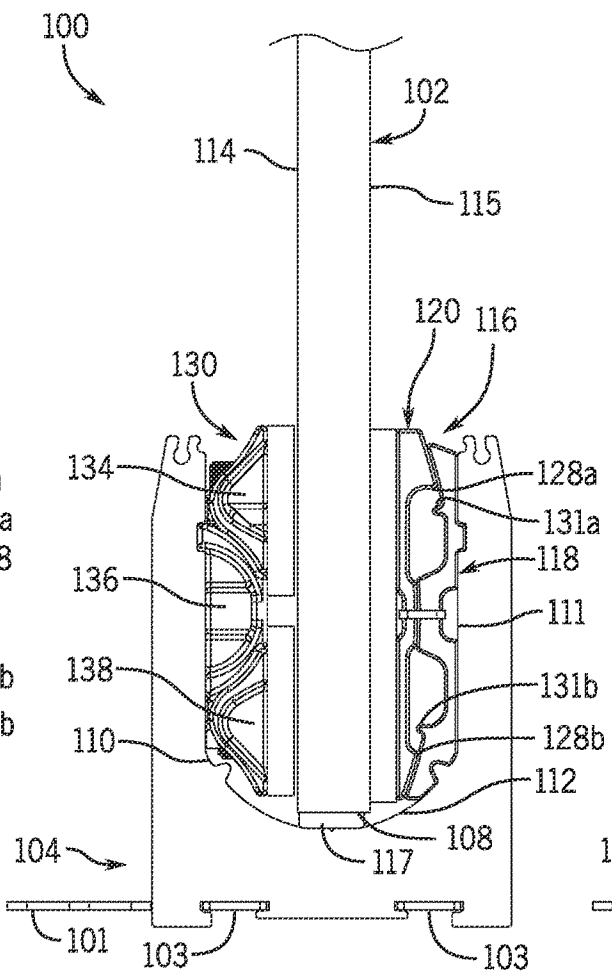
FIG. 3 is an end view of the system and partition shown in FIG. 1, showing the partition in a fixed neutral position.
Figure 2:
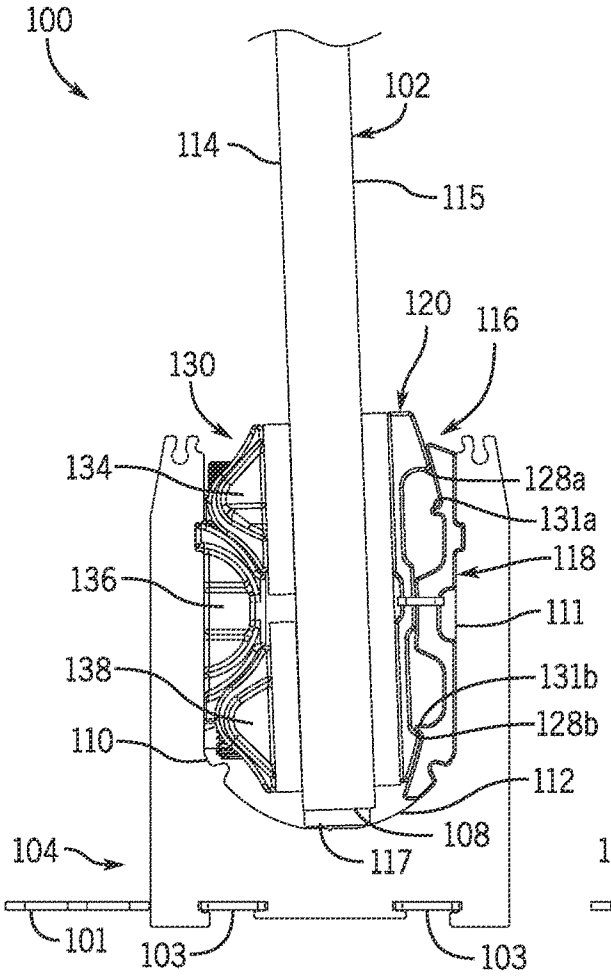
FIG. 2 is an end view of the system and partition shown in FIG. 1, showing the partition in a fixed rearward-tilted position.

During installation, the clamp assembly 130 may begin in a neutral, unengaged position, with neither the upper block 134 substantially lowered or the lower block 138 substantially raised with respect to the center block 136, allowing the clamp assembly 130 to be inserted between the partition 102 and the sidewall 110 with minimal additional labor steps. As shown in FIG. 2, the raising of the lower block 138 in a more substantial manner than the upper block 134 is lowered, with respect to the center block 136, applies a clamping force to the partition 102 that causes the pivoting component 120 to pivot in a manner that tilts the partition 102 in a rearward direction as the partition 102 is secured. Here, when the partition 102 reaches its maximum-allowed rearward tilt position, contact of the lower stop tab **128*b* with the lower stop protrusion 131*b* halts further rearward rotation of the pivoting component 120. In this embodiment, the lower block 138 is assembled with a tolerance that allows for slight articulation, such that the portion of the lower block 138 that aligns with side 114 of the partition 102 may follow the side 114 as the partition 102 pivots. As shown in FIG. 4, the lowering of the upper block 134, in a more substantial manner than the lower block 138 is raised, with respect to the center block 136, applies a clamping force to the partition 102 that causes the pivoting component 220 to pivot in a manner that tilts the partition 102 in a forward direction as the partition 102 is secured. Here, when the partition 102 reaches its maximum-allowed forward tilt position, contact of the upper stop tab 128*a* with the upper stop protrusion 131*a* halts further forward rotation of the pivoting component 120. In this embodiment, the upper block 134 is assembled with a tolerance that allows for slight articulation, such that the portion of the upper block 134 that aligns with the side 114 of the partition 102 may follow the side 114 as the partition 102 pivots. This articulation, with respect to both the upper and lower blocks 134, 138 may be effectuated, at least in part, by the curvature of the coinciding faces between the respective upper or lower block and the center block 136. Finally, as shown in FIG. 3, the lowering of the upper block 134 to substantially the same degree as the raising of the upper block 134, with respect to the center block 136, applies a clamping force to the partition 102 that does not generate substantial pivot-rotation of the pivoting component 120** and results in the partition being secured in a neutral position, without substantial forward or rearward tilt.

During installation, the clamp assembly 230 may begin in a neutral, unengaged configuration, with neither the upper block 234 substantially lowered or the lower block 238 substantially raised with respect to the center block 236, allowing the clamp assembly 230 to be inserted between the partition 202 and the sidewall 210 with minimal additional labor steps. As shown in FIG. 22, the raising of the lower block 238, while the center block 236 and the upper block 234 remain generally stationary, applies a clamping force to the partition 202 that causes the pivoting component 220 to pivot in a manner that tilts the partition 202 in a rearward direction as the partition 202 is secured. Here, when the partition 202 reaches its maximum-allowed rearward tilt position, contact of the lower stop tab **228*b* with the stationary component 218 halts further rearward rotation of the pivoting component 220. In this embodiment, the lower block 238 is assembled with a tolerance that allows for slight articulation, such that the portion of the lower block 238 that aligns with side 214 of the partition 202 may follow the side 214 as the partition 202 pivots. As shown in FIG. 24, the lowering of the upper block 234, while the center block 236 and the lower block 238 remain generally stationary, applies a clamping force to the partition 202 that causes the pivoting component 220 to pivot in a manner that tilts the partition 202 in a forward direction as the partition 202 is secured. Here, when the partition 202 reaches its maximum-allowed forward tilt position, contact of the upper stop tab 228*a* with the stationary component 218 halts further forward rotation of the pivoting component 220. In this embodiment, the upper block 234 is assembled with a tolerance that allows for slight articulation, such that the portion of the upper block 234 that aligns with the side 214 of the partition 202 may follow the side 214 as the partition 202 pivots. Finally, as shown in FIG. 23, the lowering of the upper block 234, to substantially the same degree as the raising of lower block 238, with respect to the center block 236, applies a clamping force to the partition 202 that does not generate substantial pivoting of the pivoting component 220** and results in the partition being secured in a neutral position, without substantial forward or rearward tilt.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A system for leveling and removably securing a partition, the system comprising:

a base including, a first sidewall, a second sidewall opposing the first sidewall, and a lower wall positioned at least in part between the first sidewall and the second sidewall, at least the first sidewall, the second sidewall, and the lower wall forming a slot sized to receive the partition;

a rocker assembly including, a stationary component positioned adjacent the first sidewall, and a pivoting component pivotably mated to the stationary component; and a clamp assembly including, a stationary block positioned adjacent the second sidewall, aligned at least in part with the rocker assembly, a first sliding block translatable from the second sidewall and connected to the stationary block in a manner that permits sliding with respect to the stationary block, a second sliding block translatable from the second sidewall and connected to the stationary block in a manner that permits sliding with respect to the stationary block, a first fastener having, a first fastener head at least partially bearing on a portion of the first sliding block, and a first fastener threaded portion connected to the first fastener head, a first fastener receiving element positioned at least partially within the stationary block and threadably engaged with the first fastener threaded portion, a second fastener having, a second fastener head at least partially bearing on a portion of the stationary block, and a second fastener threaded portion extending from the second fastener head, and a second fastener receiving element positioned at least partially within the second sliding block and threadably engaged with the second fastener threaded portion.

2. The system of claim 1, wherein the pivoting component is mated to the stationary component by concentric, curved surfaces.

3. The system of claim 1, wherein the stationary component is positioned directly adjacent the first sidewall and the stationary block is positioned directly adjacent the second sidewall.

4. The system of claim 3 wherein the first sidewall further comprises a first sidewall mating element, wherein the stationary component further comprises a stationary component mating element configured to mate with the first sidewall mating element, wherein the second sidewall further comprises a second sidewall mating element, and wherein the stationary block further comprises a stationary block mating element configured to mate with the second sidewall mating element.

5. The system of claim 4, wherein the stationary block mating element is configured to mate with the first sidewall mating element, and wherein the stationary component mating element is configured to mate with the second sidewall mating element.

6. The system of claim 4, wherein the stationary block mating element is a nut positioned partially within the stationary block.

7. The system of claim 4, wherein the stationary block mating element is a projection integrally formed with the stationary block.

8. The system of claim 4, wherein the stationary component mating element is comprised of an integrally formed projection engageable with an integrally formed indentation in the first sidewall.

9. The system of claim 1, wherein a channel is formed in the base opposite the slot, the channel sized to receive an alignment aid for installing the base.

10. The system of claim 9, wherein the alignment aid is a metal tab.

11. The system of claim 1, wherein the stationary block includes a first channel extending at least partially therethrough and a second channel extending completely therethrough, wherein the first fastener threaded portion passes at least partially through the first channel, and wherein the second fastener threaded portion passes completely through the second channel.

12. A system for leveling and removably securing a partition, the system comprising:

a shoe channel comprised of at least a first sidewall, a second sidewall opposite the first sidewall, and a lower face separating the first sidewall from the second sidewall;

a rocker assembly including, a stationary component connected to the first sidewall, and a pivoting component pivotably mated to the stationary component, opposite the first sidewall, and configured to rest at least partially flush against the partition during operation; and a clamp assembly spaced apart from the rocker assembly, the clamp assembly including, a center block interlocked with the second sidewall to prevent vertical translation relative to the second sidewall, the center block having an upper block coinciding face and a lower block coinciding face, an upper block adjacent the center block, the upper block having a center block coinciding face that permits sliding of the upper block with respect to the center block when the center block coinciding face is aligned with the upper block coinciding face, a lower block adjacent the center block, the lower block having a center block coinciding face that permits sliding of the lower block with respect to the center block when the center block coinciding face is aligned with the lower block coinciding face, a first fastener having, a first fastener head at least partially bearing upon a bearing surface of the upper block, and a first fastener threaded portion extending from the first fastener head, a first fastener receiving element positioned at least partially within the center block and threadably engaged with the first fastener threaded portion, a second fastener having, a second fastener head at least partially bearing upon a bearing surface of the center block, and a second fastener threaded portion extending from the second fastener head, and a second fastener receiving element positioned at least partially within the lower block and threadably engaged with the second fastener threaded portion.

13. The system of claim 12, wherein the first fastener receiving element is a nut and the second fastener receiving element is another nut.

14. The system of claim 12, wherein the upper block coinciding face and the lower block coinciding face of the center block, the center block coinciding face of the upper block, and the center block coinciding face of the lower block are curved faces.

* * * * *